US012152399B2

(12) United States Patent
Schneider et al.

(10) Patent No.: US 12,152,399 B2
(45) **Date of Patent: *Nov. 26, 2024**

(54) FENCE POST FLUSH MOUNT

(71) Applicant: Barrette Outdoor Living, Inc., Middleburg Heights, OH (US)

(72) Inventors: Christopher Michael Schneider, Linwood, NJ (US); Wayne Dixon, Chuckey, TN (US); Patrick Joseph Bertke, Mays Landing, NJ (US)

(73) Assignee: Barrette Outdoor Living, Inc., Middleburg Heights, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/211,326

(22) Filed: Jun. 19, 2023

(65) Prior Publication Data

US 2024/0052667 A1 Feb. 15, 2024

Related U.S. Application Data

(63) Continuation of application No. 17/736,588, filed on May 4, 2022, now Pat. No. 11,719,016, which is a continuation of application No. 16/856,102, filed on Apr. 23, 2020, now Pat. No. 11,352,806.

(60) Provisional application No. 62/927,215, filed on Oct. 29, 2019.

(51) Int. Cl.
*E04H 12/22* (2006.01)

(52) U.S. Cl.
CPC ..... *E04H 12/2276* (2013.01)

(58) Field of Classification Search
CPC ..... E04H 12/2276; E04H 12/2269; E04H 17/009
See application file for complete search history.

(56) References Cited

U.S. PATENT DOCUMENTS 839,829 A * 1/1907 Fell ..... E04H 12/2276 52/297
5,632,464 A * 5/1997 Aberle ..... E01F 9/685 52/298
7,055,807 B2 * 6/2006 Pesta ..... E04H 12/2269 52/297

(Continued)

FOREIGN PATENT DOCUMENTS

CA 2952129 C 8/2019
DE 102011117629 A1 * 5/2013 ..... E01F 9/681

(Continued)

*Primary Examiner* — Adriana Figueroa
(74) *Attorney, Agent, or Firm* — John Maldjian, Esq.; Stevens & Lee PC

(57) ABSTRACT

A fence post mount device comprising: a base having at least one cavity; a first universal collet having a plurality of collet legs attached to each other through at least one of a plurality of separation notches, wherein a distal end of the first universal collet is inserted into the cavity from a proximal end of the base; a first cap nut inserted into the first universal collet; a post inserted into the cavity of the base; a full thread nut threaded into the first cap nut from a distal end of the base through an opening, wherein each of the plurality of separation notches are broken when the full thread nut is tightened into the first cap nut and each of the collet legs of the first universal collet deforms an inner wall of the post such that the post is securely locked within the cavity of the base.

20 Claims, 26 Drawing Sheets

(56) References Cited

U.S. PATENT DOCUMENTS

| | | | | |
|---|---|---|---|---|
| 7,533,506 | B2 * | 5/2009 | Platt | E04H 12/2261 52/296 |
| 10,501,957 | B1 * | 12/2019 | Borowiak | E04H 12/22 |
| 11,459,786 | B2 * | 10/2022 | LeAnna | E04H 12/2269 |
| 2005/0204654 | A1 | 9/2005 | Fredrickson | |
| 2013/0175422 | A1 * | 7/2013 | Clarke | E04H 12/2269 248/523 |

FOREIGN PATENT DOCUMENTS

| | | | | |
|---|---|---|---|---|
| DE | 202014002205 | U1 * | 7/2015 | E04H 12/2238 |
| DE | 202016103118 | U | 7/2016 | |
| GB | 2324321 | A | 10/1998 | |
| GB | 2504548 | A | 2/2014 | |
| JP | 3871446 | B | 1/2007 | |
| SE | 1450730 | A1 | 12/2015 | |

* cited by examiner

FENCE POST FLUSH MOUNT

CROSS-REFERENCE TO RELATED APPLICATION

This application is a continuation of U.S. application Ser. No. 17/736,588, filed May 4, 2022, entitled "FENCE POST FLUSH MOUNT", which is a continuation of U.S. application Ser. No. 16/856,102, filed Apr. 23, 2020, entitled "FENCE POST FLUSH MOUNT", now U.S. Pat. No. 11,352,806, which claims benefit and priority to U.S. Provisional Application Ser. No. 62/927,215 filed Oct. 29, 2019, entitled "FENCE POST FLUSH MOUNT", which are incorporated herein by reference in their entirety.

BACKGROUND

Field of Invention

Embodiments disclosed herein relate, in general, to a post support, and more particularly, to a mounting device for a fence post.

Description of Related Art

Post structures have been in use for years. Conventional posts are made of wood, metal or other materials that are directly mounted onto the ground surface. Regardless of the material used to construct the post, the post generally has a uniform cross-sectional shape (e.g., square, rectangular, or circular) and size. Further, the posts supporting a wall typically have a mount driven below the depth of the ground/concrete, and the post can telescope into or onto the mount. Such mounts are sized to accommodate only a particular size of a post and further handle much less load.

Moreover, conventional base of a post mount is designed such that the post mounted on the base is tightened at the bottom, however, the post has an additional clearance at the top of the base (depending on the draft angle). Such design causes the post mounted onto the base to easily pull out and loosen when a load is applied to the post, especially, for example, when a gate is installed using the post mount, where the gate is opened and closed continuously.

Therefore, it is desirable to have a fence post mount device that can pressure fit different sized fence posts and further provide better structural strength to the posts.

SUMMARY

Embodiments of the present invention are directed to a fence post mount device comprising: a base, wherein the base comprises at least one cavity; a first universal collet having a plurality of collet legs such that each collet leg is attached to an adjacent collet leg through at least one of a plurality of separation notches, wherein a distal end of the first universal collet is inserted into the cavity from a proximal end of the base; a first cap nut inserted into the first universal collet from a proximal end of the first universal collet; a post inserted into the cavity of the base circumscribing the first universal collet; a full thread nut threaded into the first cap nut from a distal end of the base through an opening, wherein each of the plurality of separation notches between the each of the adjacent collet legs are broken when the full thread nut is tightened into the first cap nut and each of the collet legs of the first universal collet deforms an inner wall of the post such that the post is securely locked within the cavity of the base; and a plurality of attachment grooves, provided at each corner of the base, to attach the base to a surface by using a plurality of attachment tools.

Embodiments of the present invention are directed to a fence post mount device comprising: a base, wherein the base comprises at least one cavity; a first universal collet having a plurality of collet legs such that each collet leg is attached to an adjacent collet leg through at least one of a plurality of separation notches, wherein a distal end of the first universal collet is inserted into the cavity from a proximal end of the base; a first cap nut inserted into the first universal collet from a proximal end of the first universal collet; a post inserted into the cavity of the base circumscribing the first universal collet; a full thread nut threaded into the first cap nut from a distal end of the base through an opening, wherein each of the plurality of separation notches between the each of the adjacent collet legs are broken when the full thread nut is tightened into the first cap nut and each of the collet legs of the first universal collet deforms an inner wall of the post such that the post is securely locked within the cavity of the base; a plurality of attachment grooves, provided at each corner of the base, to attach the base to a surface by using a plurality of attachment tools; and a plurality of base covers, provided to cover the base.

Embodiments of the present invention are directed to a method of installing a post using a fence post mount device, the method comprising steps of: inserting a first universal collet into a cavity of a base from a proximal end of the base, wherein the first universal collet comprises a plurality of collet legs such that each collet leg is attached to an adjacent collet leg through at least one of a plurality of separation notches; inserting a first cap nut into the first universal collet from a proximal end of the first universal collet; inserting a post into the cavity of the base circumscribing the first universal collet; threading a full thread nut into the first cap nut from a distal end of the base through an opening; tightening the full thread nut, wherein each of the plurality of separation notches between the each of the adjacent collet legs are broken when the full thread nut is threaded into the first cap nut; and securing the base to a surface by using a plurality of attachment tools tightened into a plurality of attachment grooves provided at each corner of the base.

Embodiments of the present invention are directed to a fence post mount device having an adjustable structure for accommodating posts of different sizes with different sized collets. An internal structure of the fence post mount device may split into four corners of a post when a full thread nut is tightened.

Embodiments in accordance with the present invention provide a fence post mount device having an adjustable structure for accommodating a 2 inches post.

Embodiments in accordance with the present invention provide a fence post mount device having an adjustable structure for accommodating a 2.5 inches post.

Embodiments of the present invention may provide a number of advantages depending on its particular configuration. It is an object of the present invention to provide a fence post mount device having an adjustable structure for accommodating posts of different sizes with different sized collets.

These and other advantages will be apparent from the present application of the embodiments described herein.

The preceding is a simplified summary to provide an understanding of some embodiments of the present invention. This summary is neither an extensive nor exhaustive overview of the present invention and its various embodiments. The summary presents selected concepts of the embodiments of the present invention in a simplified form as an introduction to the more detailed description presented below. As will be appreciated, other embodiments of the present invention are possible utilizing, alone or in combination, one or more of the features set forth above or described in detail below.

BRIEF DESCRIPTION OF THE DRAWINGS

The foregoing and other aspects of the embodiments disclosed herein are best understood from the following detailed description when read in connection with the accompanying drawings. For the purpose of illustrating the embodiments disclosed herein, there is shown in the drawings embodiments that are presently preferred, it being understood, however, that the embodiments disclosed herein are not limited to the specific instrumentalities disclosed. Included in the drawings are the following figures.

Figure 1A:
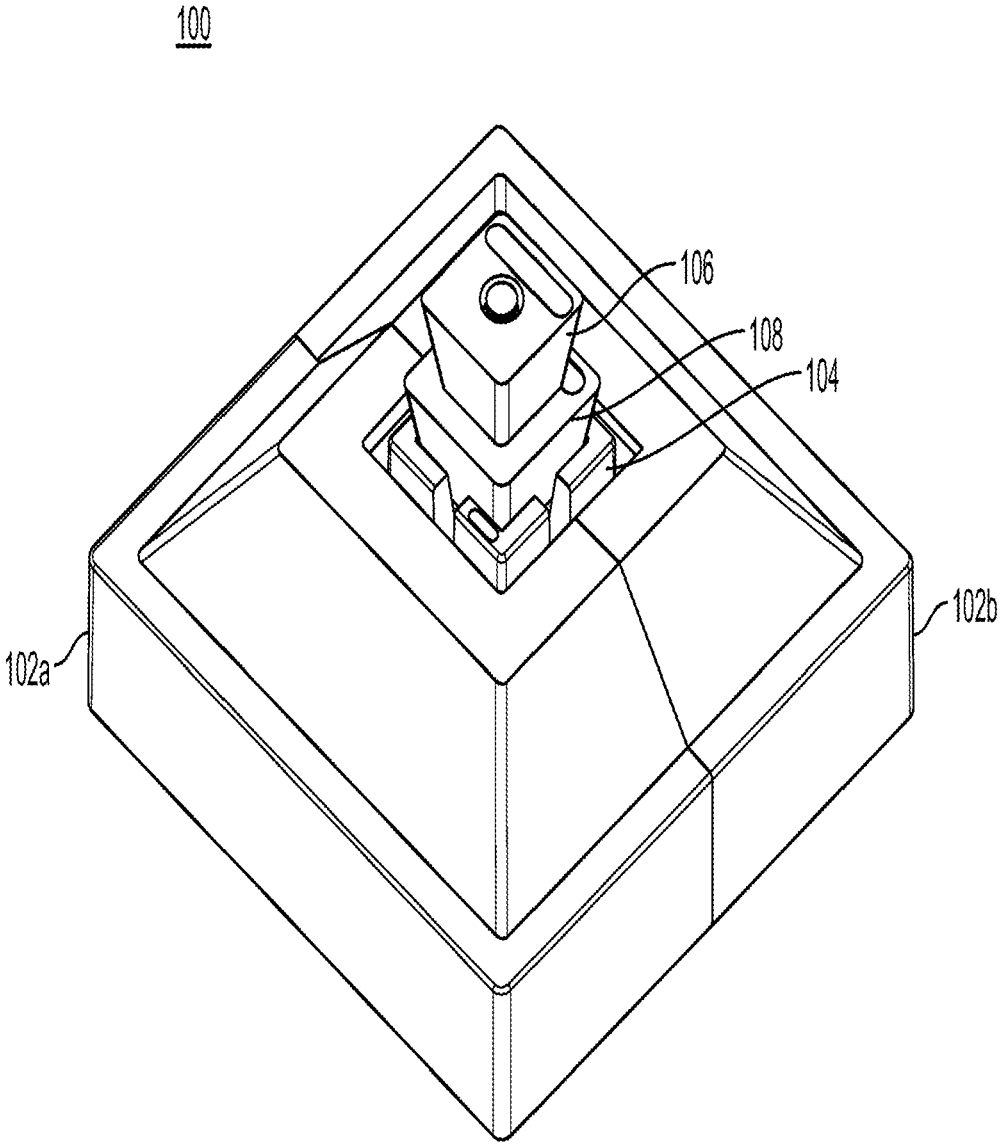
FIG. 1A illustrates an assembled perspective view of a fence post mount device to mount a 2 inches post, according to an embodiment of the present invention disclosed herein.

While embodiments of the present invention are described herein by way of example using several illustrative drawings, those skilled in the art will recognize the present invention is not limited to the embodiments or drawings described. It should be understood the drawings and the detailed description thereto are not intended to limit the present invention to the particular form disclosed, but to the contrary, the present invention is to cover all modification, equivalents and alternatives falling within the spirit and scope of embodiments of the present invention as defined by the appended claims.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

Embodiments of the present invention will be described below in conjunction with an exemplary fence post mount device. Embodiments of the present invention are not limited to any particular type of fence post mount device. Those skilled in the art will recognize the disclosed techniques may be used in any fence post mount device in which it is desirable to mount different sized post on a surface by using the fence post mount device.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

The term "proximal end" and variations thereof, as used herein, refers to a reference position of components indicating away from a surface on which the fence post mount device is to be installed.

The term "distal end" and variations thereof, as used herein, refers to a reference position of components facing towards the surface on which the fence post mount device is to be installed.

FIG. 1A illustrates an assembled perspective view of a fence post mount device 100 to mount a 2 inches post, according to an embodiment of the present invention. The fence post mount device 100 comprises base covers 102*a*-102*b*, a first universal collet 104, a first cap nut 106, and a second cap nut 108, according to an embodiment of the present invention. The base covers 102*a*-102*b*, the first universal collet 104, the first cap nut 106, and the second cap nut 108 may be made up of a material such as, but not limited to, an aluminum alloy, a steel alloy, a copper-based alloy, a magnesium alloy, a zinc alloy, and so forth. In a preferred embodiment of the present invention, the base covers 102*a*-102*b*, the first universal collet 104, the first cap nut 106, and the second cap nut 108 may be made up of an aluminum 380.0-F. Embodiments of the present invention are intended to include or otherwise cover any type of the material including known, related art, and/or later developed technologies.

In an embodiment of the present invention, the base covers 102*a*-102*b* may be used to cover the fence post mount device 100 when assembled and mounted on a surface. According to embodiments of the present invention, the surface may be, but not limited to, a ground, a footpath, a floor, and so forth. Embodiments of the present invention are intended to include or otherwise cover any type of the surface including known, related art, and/or later developed technologies.

Figure 1B:
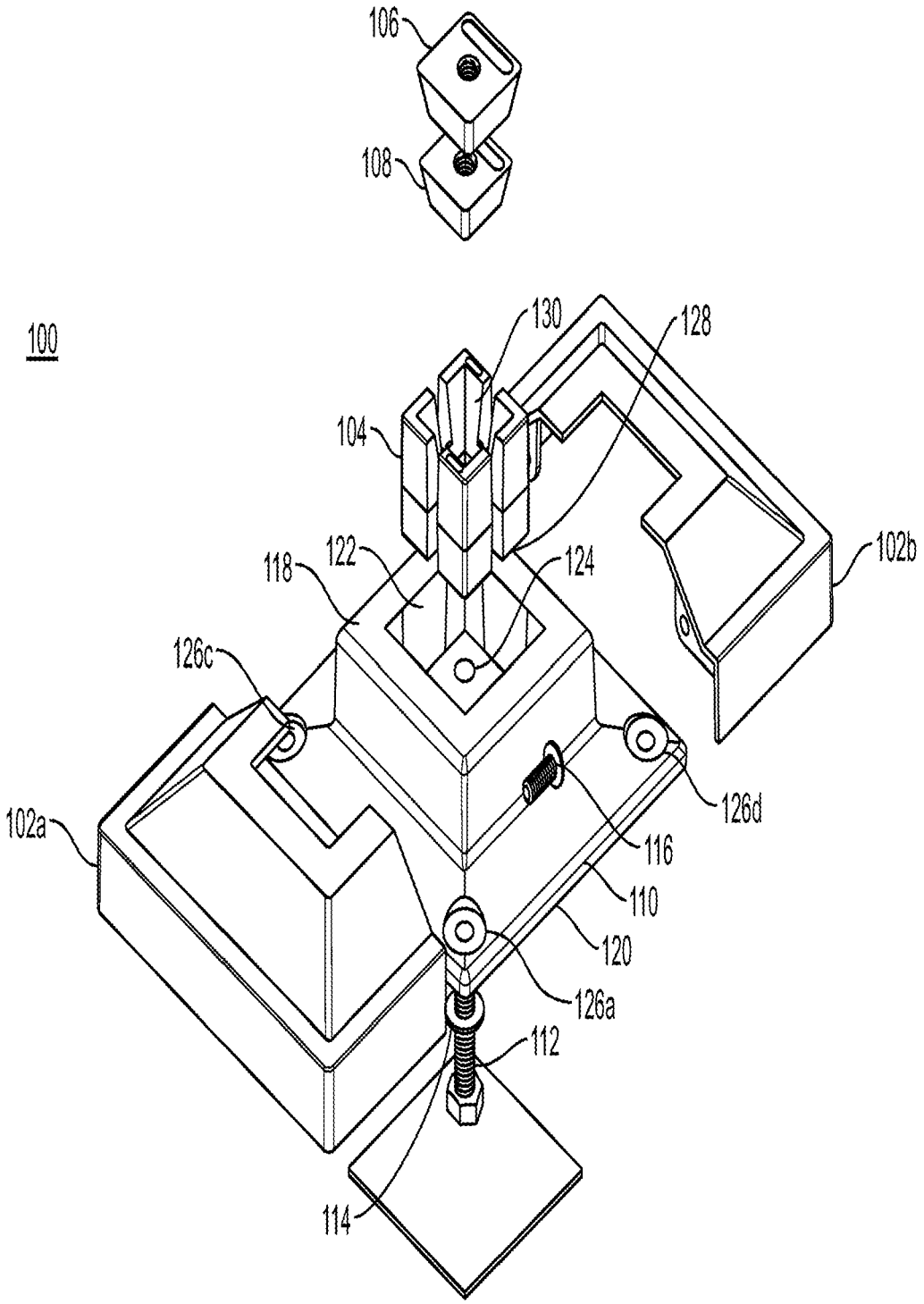
FIG. 1B illustrates an exploded perspective view of the fence post mount device to mount a 2 inches post, according to an embodiment of the present invention disclosed herein.

FIG. 1B illustrates an exploded perspective view of the fence post mount device 100 to mount the 2 inches post, according to an embodiment of the present invention. The fence post mount device 100 comprises the base covers 102*a*-102*b*, the first universal collet 104, the first cap nut 106, the second cap nut 108, a base 110, a full thread nut 112, a washer 114, and an attachment plug 116. According to an embodiment of the present invention, the base 110 may comprise a proximal end 118 and a distal end 120. The proximal end 118 of the base 110 may further comprise a cavity 122 that may be provided to accept the first universal collet 104. According to embodiments of the present invention, a shape of the cavity 122 may be, but not limited to, a rectangle, a square, a circle, and so forth. In an embodiment of the present invention, the shape of the cavity 122 may be according to a shape of a post that may be required to be mounted using the fence post mount device 100.

The distal end 120 of the base 110 may comprise an opening 124 for accepting the full thread nut 112, in an embodiment of the present invention. The full thread nut 112 may be configured to be threaded into the first cap nut 106 through the washer 114, in an embodiment of the present invention. In another embodiment of the present invention, the full thread nut 112 may be configured to be threaded into the second cap nut 108 through the washer 114. Further, the base 110 may comprise attachment grooves 126*a*-126*d* (hereinafter referred to as the attachment groove 126) at each corner of the base 110. The attachment grooves 126 may be designed to accept at least one of attachment tools (not shown), according to embodiments of the present invention. According to embodiments of the present invention, the attachment tool may be for example, but not limited to, a screw, a nail, a nut, and so forth. Embodiments of the present invention are intended to include or otherwise cover any type of the attachment tools including known, related art, and/or later developed technologies that may be capable of securing the base 110 to the surface.

According to embodiments of the present invention, the first universal collet 104 may comprise a distal end 128 and a proximal end 130. In an exemplary scenario, if a 2 inches×1/16 inches post is to be mounted using the fence post mount device 100, then the distal end 128 of the first universal collet 104 may be inserted into the cavity 122 of the base 110. The first cap nut 106 may be inserted from the proximal end 130 of the first universal collet 104. Further, the 2 inches×1/16 inches post may be inserted into the cavity 122 such that the 2 inches×1/16 inches post circumscribes the first universal collet 104, in an embodiment of the present invention. Furthermore, the full thread nut 112 may be inserted through the opening 124 provided at the distal end 120 of the base 110 and threaded into the first cap nut 106, according to an embodiment of the present invention. In other embodiments, the dimensions of the post will be greater than or less than 2 inches×1/16 inches.

In another exemplary scenario, if a 2 inches×1/8 inches post is to be mounted using the fence post mount device 100, then the proximal end 130 of the first universal collet 104 may be inserted into the cavity 122 of the base 110. Further, the second cap nut 108 may be inserted from the distal end 128 of the first universal collet 104. Furthermore, the 2 inches×1/8 inches post may be inserted into the cavity 122 such that the 2 inches×1/8 inches post circumscribes the first universal collet 104, in an embodiment of the present invention. According to an embodiment of the present invention, the full thread nut 112 may be inserted through the opening 124 provided at the distal end 120 of the base 110 and threaded into the second cap nut 108, according to an embodiment of the present invention. In other exemplary scenarios, the post dimensions will be greater than or less than 2 inches×1/8 inches.

According to embodiments of the present invention, the base covers 102*a*-102*b* may be used to cover the base 110 of the fence post mount device 100 when assembled and mounted on a surface. The base covers 102*a*-102*b* may be attached to each other using the attachment plug 116, as discussed in the FIG. 1A. In an embodiment of the present invention, the attachment plug 116 may be, but not limited to, a plastic push pin, a polyvinyl plug, a plastic plug, and so forth. In another embodiment of the present invention, the attachment plug 116 may be a snap lock plug that may be capable of locking the base covers 102*a*-102*b* when the base covers 102*a*-102*b* are pushed horizontally towards each other. Embodiments of the present invention are intended to include or otherwise cover any type of the attachment plug 116 including known, related art, and/or later developed technologies that may be capable of attaching the base covers 102*a*-102*b*.

Figure 1C:
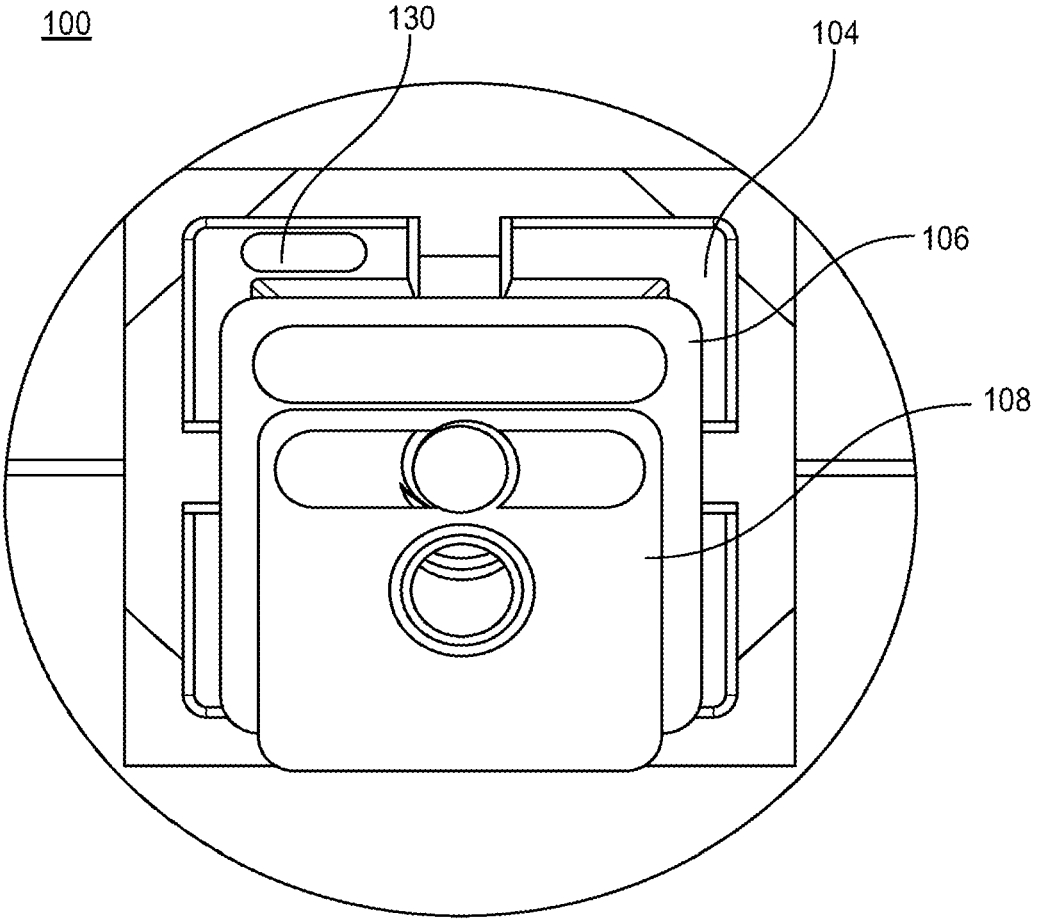
FIG. 1C illustrates an enlarged top view of the fence post mount device to mount a 2 inches post, according to an embodiment of the present invention disclosed herein.

FIG. 1C illustrates an enlarged top view of the fence post mount device 100 to mount the 2 inches post, according to an embodiment of the present invention. The distal end 128 of the first universal collet 104 may be inserted into the cavity 122 of the base 110, in an embodiment of the present invention. Further, the proximal end 130 of the first universal collet 104 may be designed to receive the first cap nut 106, in an embodiment of the present invention.

Figure 2A:
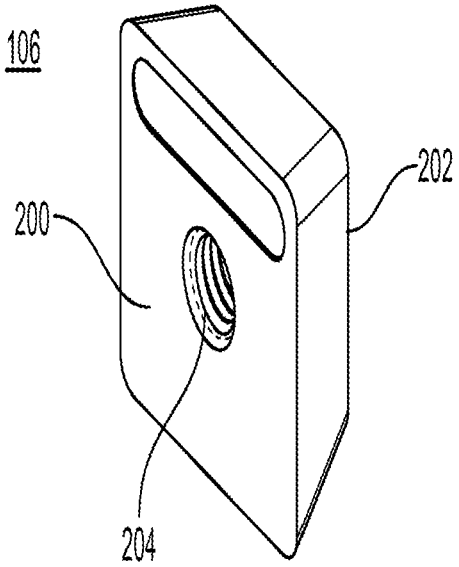
FIGS. 2A-2D illustrate different views of a first cap nut of the fence post mount device to mount the 2 inches post, according to an embodiment of the present invention disclosed herein.
Figure 16A:
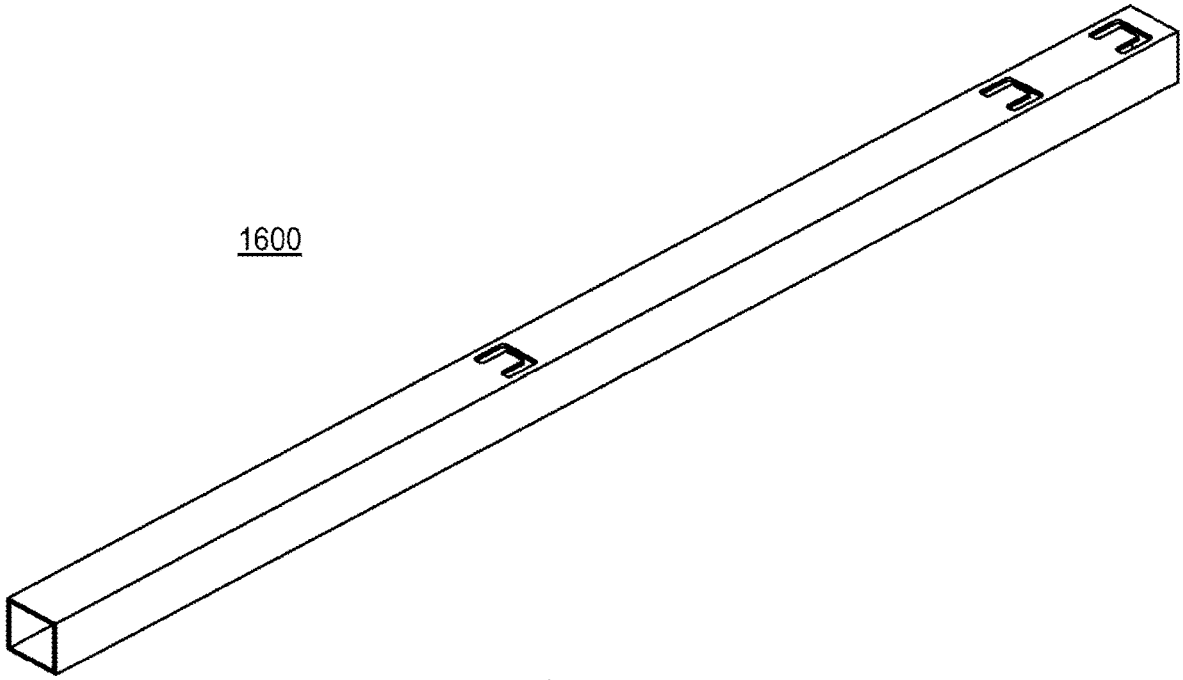
FIG. 16A illustrate a perspective view of a 2 inches post, according to an embodiment of the present invention disclosed herein.

FIGS. 2A-2D illustrate different views of the first cap nut 106 of the fence post mount device 100 to mount the 2 inches post, according to an embodiment of the present invention. FIG. 2A illustrates a perspective view of the first cap nut 106, according to an embodiment of the present invention. The first cap nut 106 may be a 2 inches×1/16 inches cap nut designed to be used for mounting a 2 inches×1/16 inches post (as shown in FIG. 16A). The first cap nut 106 may comprise a proximal end 200, a distal end 202 and a longitudinal groove 204, according to an embodiment of the present invention. In an embodiment of the present invention, a width of the proximal end 200 of the first cap nut 106 may be greater than a width of the distal end 202 of the first cap nut 106. Further, the first cap nut 106 may be made up of a material such as, but not limited to, an aluminum alloy, a steel alloy, a copper-based alloy, a magnesium alloy, a zinc alloy, and so forth. In a preferred embodiment of the present invention, the first cap nut 106 may be made up of an aluminum 380.0-F. In an embodiment of the present invention, a shape of the first cap nut 106 may be trapezoid. In other embodiments, the cap nut 106 and post will have dimensions greater than or less than 2 inches×1/16 inches.

Figure 2B:
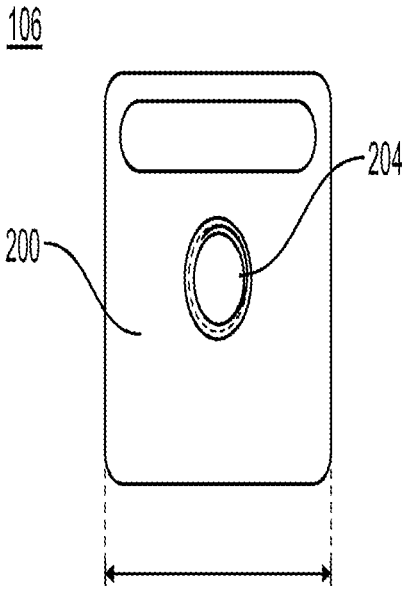

FIG. 2B illustrates a top view of the first cap nut 106, according to an embodiment of the present invention. A width of the proximal end 200 of the first cap nut 106 may be 1.450 inches, in an embodiment of the present invention. Further, the longitudinal groove 204 may be provided at a center of the proximal end 200 of the first cap nut 106. The longitudinal groove 204 may be a threaded groove that may be capable of accepting the full thread nut 112, according to embodiments of the present invention. Further, the proximal end 200 of the first cap nut 106 may have curved edges at each corner. The curved edges may have a true radius of 0.125 millimeter (mm), in an embodiment of the present invention.

Figure 2C:
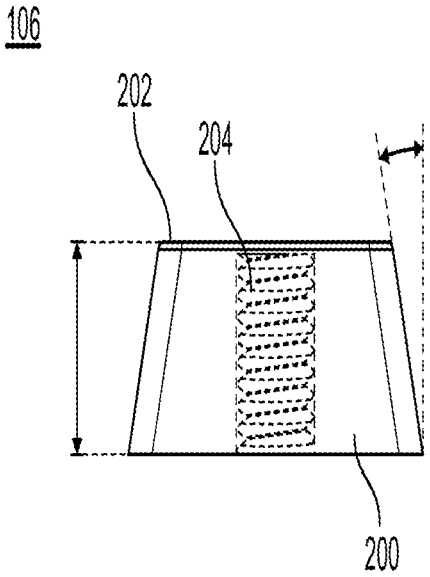

FIG. 2C illustrates a cross-sectional side view of the first cap nut 106, according to an embodiment of the present invention. A height of the first cap nut 106 may be 0.563 inches, in an embodiment of the present invention. Further, the first cap nut 106 may comprise sides that may be slanted from the proximal end 200 towards the distal end 202. The angle of each of the slanted sides may be 15° with respect to a vertical axis of the first cap nut 106, according to an embodiment of the present invention.

Figure 2D:
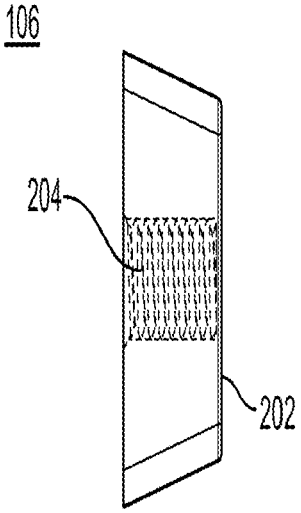

FIG. 2D illustrates a cross-sectional side view of the first cap nut 106, according to an embodiment of the present invention. The distal end 202 of the first cap nut 106 may have curved edge at a junction where the slanted sides of the first cap nut 106 meets with the distal end 202 of the first cap nut 106. The curved edge may have a radius of 0.015 mm, in an embodiment of the present invention. Further, the longitudinal groove 204 may have a class 2B Unified Coarse Pitch (UNC) thread having a nominal size and a thread per inch of 3/8-16, in an embodiment of the present invention.

Figure 3A:
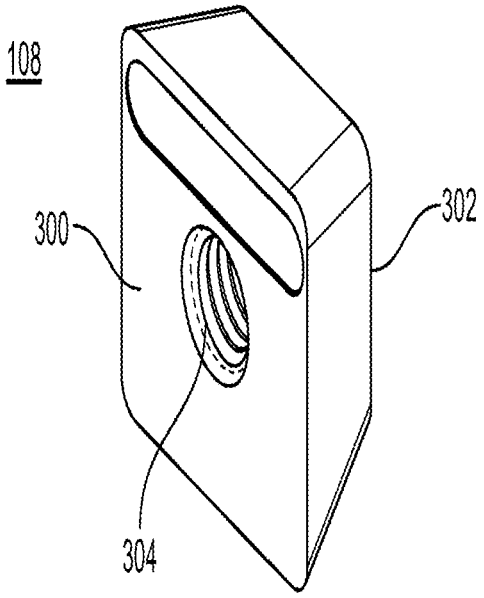
FIGS. 3A-3D illustrate different views of a second cap nut of the fence post mount device to mount the 2 inches post, according to an embodiment of the present invention disclosed herein.

FIGS. 3A-3D illustrate different views of the second cap nut 108 of the fence post mount device 100 to mount the 2 inches post, according to an embodiment of the present invention. FIG. 3A illustrates a perspective view of the second cap nut 108, according to an embodiment of the present invention. The second cap nut 108 may be a 2 inches×1/8 inches cap nut designed to be used for mounting a 2 inches×1/8 inches post. In other embodiments, the second cap nut 108 will have dimensions greater than or less than 2 inches×1/8 inches The second cap nut 108 may comprise a proximal end 300, a distal end 302 and a longitudinal groove 304, according to an embodiment of the present invention. In an embodiment of the present invention, a width of the proximal end 300 of the second cap nut 108 may be greater than a width of the distal end 302 of the second cap nut 108. Further, the second cap nut 108 may be made up of a material such as, but not limited to, an aluminum alloy, a steel alloy, a copper-based alloy, a magnesium alloy, a zinc alloy, and so forth. In a preferred embodiment of the present invention, the second cap nut 108 may be made up of an aluminum 380.0-F. In an embodiment of the present invention, a shape of the second cap nut 108 may be trapezoid.

Figure 3B:
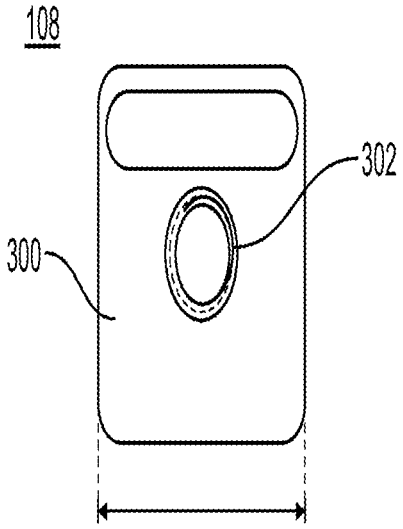

FIG. 3B illustrates a top view of the second cap nut 108, according to an embodiment of the present invention. The width of the proximal end 300 of the second cap nut 108 may be 1.210 inches, in an embodiment of the present invention. Further, the longitudinal groove 304 may be provided at a center of the proximal end 300 of the second cap nut 108. The longitudinal groove 304 may be a threaded groove that may be capable of accepting the full thread nut 112, according to embodiments of the present invention. Further, the proximal end 300 of the second cap nut 108 may have curved edges at each corner. The curved edges may have a true radius of 0.125 mm, in an embodiment of the present invention.

Figure 3C:
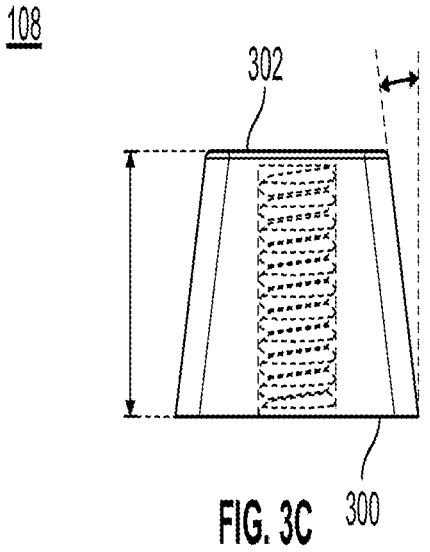

FIG. 3C illustrates a cross-sectional side view of the second cap nut 108, according to an embodiment of the present invention. A height of the second cap nut 108 may be 0.563 inches, in an embodiment of the present invention. Further, the second cap nut 108 may comprise sides that may be slanted from the proximal end 300 towards the distal end 302. The angle of each of the slanted sides may be 15° with respect to a vertical axis of the second cap nut 108, according to an embodiment of the present invention.

Figure 3D:
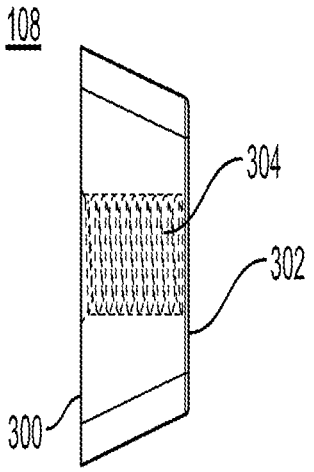

FIG. 3D illustrates a cross-sectional side view of the second cap nut 108, according to an embodiment of the present invention. The distal end 302 of the second cap nut 108 may have a curved edge at a junction where the slanted sides of the second cap nut 108 meets with the distal end 302 of the second cap nut 108. The curved edge may have a radius of 0.015 mm, in an embodiment of the present invention. Further, the longitudinal groove 304 may have a class 2B UNC thread having a nominal size and a thread per inch of 3/8-16, in an embodiment of the present invention.

Figure 4A:
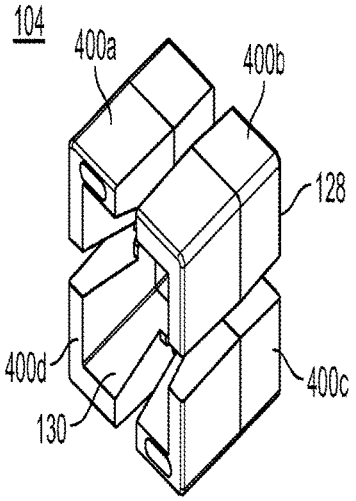
FIGS. 4A-4F illustrate different views of a first universal collet of the fence post mount device to mount the 2 inches post, according to an embodiment of the present invention disclosed herein.

FIGS. 4A-4F illustrate different views of the first universal collet 104 of the fence post mount device 100 to mount the 2 inches post, according to embodiments of the present invention. FIG. 4A illustrates a perspective view of the first universal collet 104, according to an embodiment of the present invention. The first universal collet 104 may comprise collet legs 400*a*-400*d* (hereinafter referred to as the collet leg 400), according to embodiments of the present invention. According to embodiments of the present invention, each of the collet leg 400 may be a L-shaped leg attached to the adjacent collet leg 400 to form a rectangular shaped first universal collet 104 having an opening at both the distal end 128 and the proximal end 130.

Figure 4B:
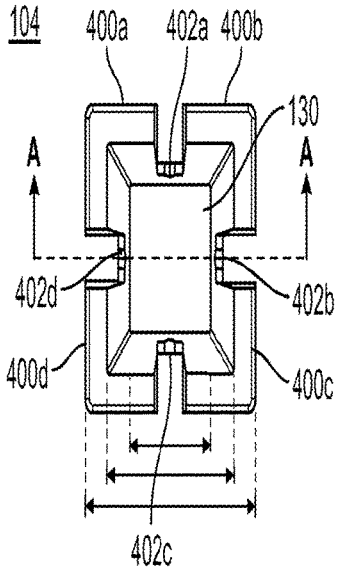

FIG. 4B illustrates a top view of the first universal collet 104, according to an embodiment of the present invention. Each of the collet leg 400 may be attached to the adjacent collet leg 400 through at least one of a separation notches 402*a*-402*d*, according to embodiments of the present invention. According to embodiments of the present invention, each of the collet leg 400 may have a slanted inner wall that may extend vertically downwards from the proximal end 130 to a transition point 404 (as shown in FIG. 4D). A length of the slanted inner wall from a surface of the proximal end 130 to the transition point 404 may be 0.837 inches (as shown in FIG. 4D). According to embodiments of the present invention, each of the collet leg 400 may have a slanted inner wall that may extend vertically downwards from the distal end 128 to the transition point 404. A length of the slanted inner wall from a surface of the distal end 128 to the transition point 404 may be 0.601 inches (as shown in FIG. 4D). Further, an angle of each of the slanted inner wall may be 15° with respect to a vertical axis of the first universal collet 104, according to embodiments of the present invention. The proximal end 130 of the first universal collet 104 may be designed to receive the first cap nut 106 for mounting the 2 inches×1/16 inches post, according to an embodiment of the present invention. In other embodiments, the post will be greater than or less than 2 inches×1/16 inches.

Further, an outer width of the first universal collet 104 may be 1.675 inches, in an embodiment of the present invention. An inner width of the first universal collet 104 at the surface of the proximal end 130 may be 1.125 inches, in an embodiment of the present invention. Furthermore, an inner width of the first universal collet 104 at the transition point may be 0.803 inches, according to embodiments of the present invention.

Figure 4C:
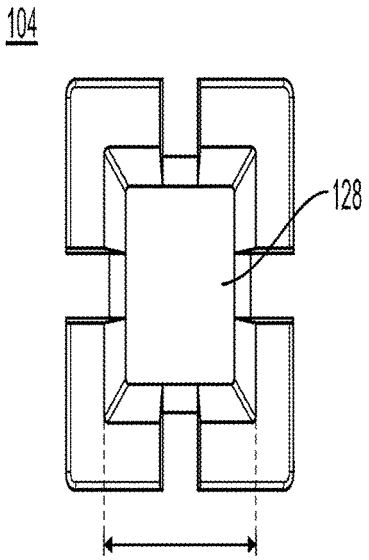
Figure 4D:
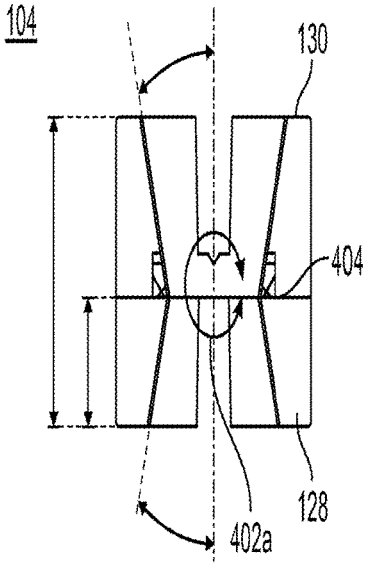

FIG. 4C illustrates a bottom view of the first universal collet 104, according to an embodiment of the present invention. The distal end 128 of the first universal collet 104 may be designed to receive the second cap nut 108 for mounting the 2 inches×1/8 inches post, according to an embodiment of the present invention. An inner width of the first universal collet 104 at the surface of the distal end 128 may be 1.125 inches, in an embodiment of the present invention. In other embodiments, the dimensions of the post can be greater than or less than 2 inches×1/8 inches.

FIG. 4D illustrates a side view of the first universal collet 104, according to an embodiment of the present invention. According to embodiments of the present invention, each of the collet leg 400 may have a slanted inner wall that may extend vertically downwards from the proximal end 130 to the transition point 404, as discussed in the FIG. 4B. A length of the slanted inner wall from a surface of the proximal end 130 to the transition point 404 may be 0.837 inches. According to embodiments of the present invention, each of the collet leg 400 may have a slanted inner wall that may extend vertically downwards from the distal end 128 to the transition point 404. A length of the slanted inner wall from a surface of the distal end 128 to the transition point 404 may be 0.601 inches, in an embodiment of the present invention.

Figure 4E:
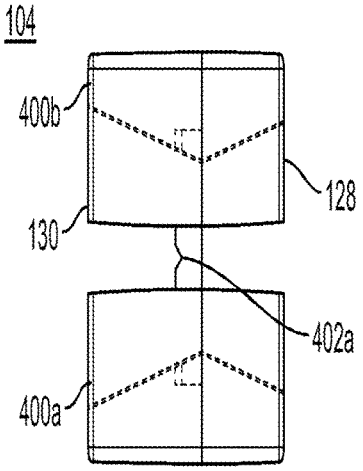

FIG. 4E illustrates a side perspective view of the first universal collet 104, according to an embodiment of the present invention. According to an embodiment of the present invention, the collet leg 400*a* may be attached to the adjacent collet leg 400*b* through the separation notch 402*a*, according to embodiments of the present invention.

Figure 4F:
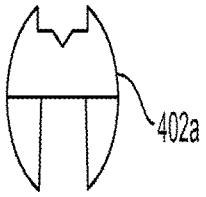

FIG. 4F illustrates an enlarged view of the separation notch 402*a* of the first universal collet 104, according to an embodiment of the present invention. The separation notch 402*a* may be a breakable notch that may be configured to be broken by a force applied by the collet leg 400 on each of the slanted inner walls of the first universal collet 104 when the first cap nut 106 is tightened, in an embodiment of the present invention. In another embodiment of the present invention, the separation notch 402*a* may be a breakable notch that may be configured to be broken by a force applied by the collet leg 400 on each of the slanted inner walls of the first universal collet 104 when the second cap nut 108 is tightened.

Figure 5A:
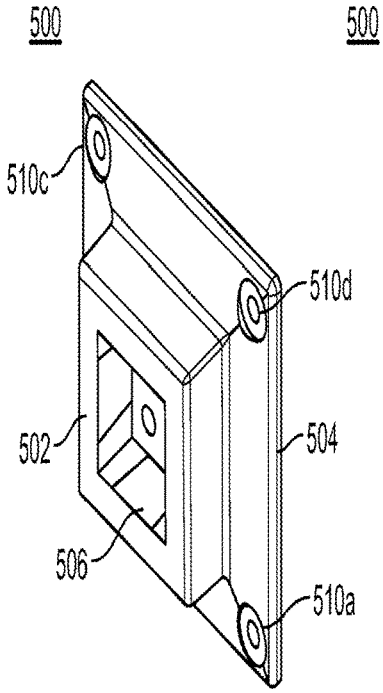
FIGS. 5A-5E illustrate different views of a base of the fence post mount device to mount the 2 inches post, according to an embodiment of the present invention disclosed herein.
Figure 5B:
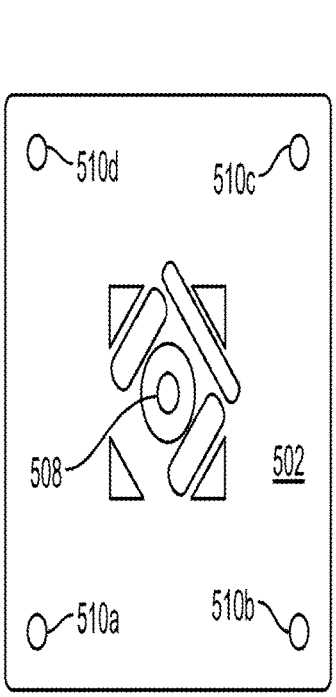

FIGS. 5A-5E illustrate different views of the base 500 of the fence post mount device 100 to mount the 2 inches post, according to embodiments of the present invention. FIG. 5A illustrates a perspective view of the base 500, according to an embodiment of the present invention. According to an embodiment of the present invention, the base 500 may comprise a proximal end 502 and a distal end 504. The proximal end 502 of the base 500 may further comprise a cavity 506 that may be provided to accept the first universal collet 104. According to embodiments of the present invention, a shape of the cavity 506 may be, but not limited to, a rectangle, a square, a circle, and so forth. In an embodiment of the present invention, the shape of the cavity 506 may be according to a shape of a post that may be required to be mounted using the fence post mount device 100. The distal end 504 of the base 500 may comprise an opening 508 (as shown in FIG. 5B) for accepting the full thread nut 112, in an embodiment of the present invention. Further, the base 500 may comprise attachment grooves 510*a*-510*d* (hereinafter referred to as the attachment grooves 510) at each corner of the base 500. The attachment grooves 510 may be designed to accept at least one attachment tool (not shown) to attach the base 500 with a surface, according to embodiments of the present invention. According to embodiments of the present invention, the base 500 may be made up of a material such as, but not limited to, an aluminum alloy, a steel alloy, a copper-based alloy, a magnesium alloy, a zinc alloy, and so forth. In a preferred embodiment of the present invention, the base 500 may be made up of an aluminum 380.0-F. Embodiments of the present invention are intended to include or otherwise cover any type of the material for the base 500 including known, related art, and/or later developed technologies.

Figure 5C:
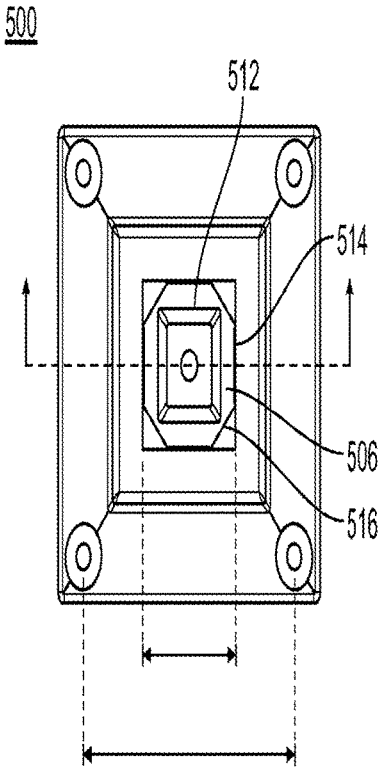

FIG. 5B illustrates a bottom view of the base 500, according to an embodiment of the present invention. The distal end 504 of the base 500 may comprise the opening 508 for accepting the full thread nut 112, in an embodiment of the present invention. In an embodiment of the present invention, a diameter of the opening 508 may be 0.377 inches (as shown in FIG. 5C). Further, the base 500 may comprise the attachment grooves 510 at each corner of the base 500. The attachment grooves 510 may be designed to accept at least one attachment tool (not shown) to attach the base 500 with a surface, as discussed, according to embodiments of the present invention. In an embodiment of the present invention, a diameter of the attachment grooves 510 may be 0.332 inches (as shown in the FIG. 5C).

FIG. 5C illustrates a top view of the base 500, according to an embodiment of the present invention. The cavity 506 of the base 500 may include a support nut 512, in an embodiment of the present invention. The support nut 512 may have a shape similar to the first cap nut 106, in an embodiment of the present invention. In another embodiment of the present invention, a shape of the support nut 512 may be similar to the second cap nut 108. Further, the support nut 512 may be manufactured integrally with the cavity 506 of the base 500, in an embodiment of the present invention. In another embodiment of the present invention, the support nut 512 may be manually attached during installation of a post using the fence post mount device 100.

Furthermore, the cavity 506 may have an inner wall 514 extending vertically downwards towards the distal end 504 of the base 500. In an embodiment of the present invention, each corner of the inner wall 514 and a surface of the cavity 506 along each of the corner may include an angled depression 516. The angled depression 516 may be capable of coring an outer wall of a post that is to be installed using the fence post mount device 100, according to embodiments of the present invention. Further, the angled depression 516 may allow the first universal collet 104 to deform an inner wall of the post when tightened by using the full thread nut 112 thus securely locking the post inserted into the cavity 506 of the base 500, in an embodiment of the present invention. According to an embodiment of the present invention, a width of the cavity 506 may be 2.018 inches. Further, a length between the two corresponding attachment grooves 510 may be 4.625 inches, in an embodiment of the present invention.

Figure 5D:
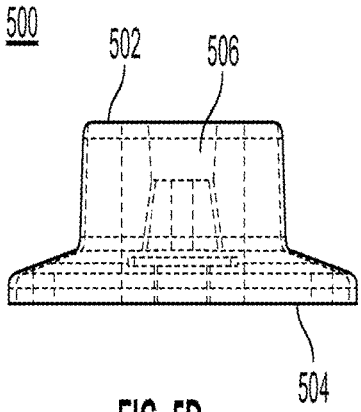

FIG. 5D illustrates a side view of the base 500, according to an embodiment of the present invention. In an embodiment of the present invention, a total width of the base 500 may be 5.750 inches. Further, a total height of the base 500 from the proximal end 502 to the distal end 504 may be 1.625 inches. Furthermore, a height of the cavity 506 may be 1.250 inches, according to an embodiment of the present invention.

Figure 5E:
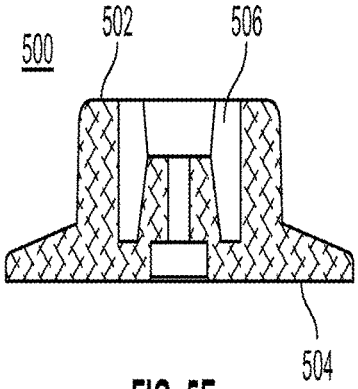

FIG. 5E illustrates a cross-sectional side view of the base 500, according to an embodiment of the present invention. The cross-sectional view illustrates that the first universal collet 104 is inserted into the cavity 506 of the base 500. Further, the first universal collet 104 is attached with a full thread nut 112 inserted from the distal end 504 of the base 500.

Figure 6A:
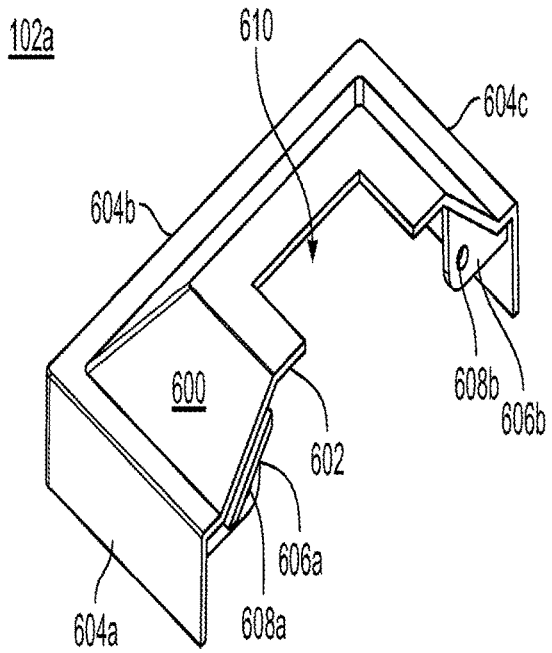
FIGS. 6A-6G illustrate different views of base covers of the fence post mount device to mount the 2 inches post, according to an embodiment of the present invention disclosed herein.

FIGS. 6A-6G illustrate different views of the base covers 102*a*-102*b* of the fence post mount device 100 to mount the 2 inches post, according to embodiments of the present invention. FIG. 6A illustrates a perspective view of the base cover 102*a* of the base covers 102*a*-102*b*, according to an embodiment of the present invention. The base cover 102*a* may comprise a top surface 600, a bottom surface 602, side faces 604*a*-604*c* and pin lips 606*a*-606*b*, according to embodiments of the present invention. Further, the pin lip 606*a* may comprise a pin hole 608*a* and the pin lip 606*b* may comprise a pin hole 608*b*. The pin hole 608*a* and the pin hole 608*b* may be capable of accepting the attachment plug 116 (as shown in the FIG. 1B). As discussed, the attachment plug 116 may be, but not limited to, a plastic push pin, a polyvinyl plug, a plastic plug, and so forth. Embodiments of the present invention are intended to include or otherwise cover any type of the attachment plug 116 including known, related art, and/or later developed technologies that may be capable of attaching the base covers 102*a*-102*b*.

Further, the top surface 600 of the base cover 102*a* may comprise an opening 610 that may be designed to accommodate a 2 inches post, in an embodiment of the present invention. According to embodiments of the present invention, the base covers 102*a*-102*b* may be made up of a material such as, but not limited to, an aluminum alloy, a steel alloy, a copper-based alloy, a magnesium alloy, a zinc alloy, and so forth. Embodiments of the present invention are intended to include or otherwise cover any type of the material for the base covers 102*a*-102*b* including known, related art, and/or later developed technologies.

Figure 6B:
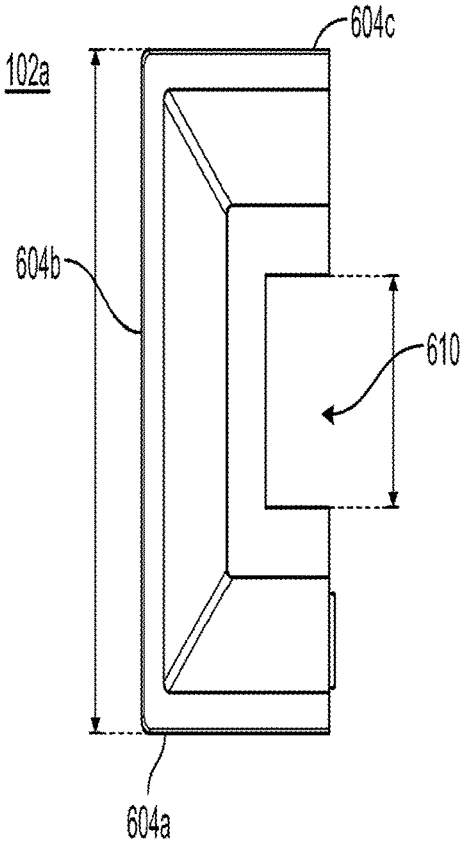

FIG. 6B illustrates a top view of the base cover 102*a*, according to an embodiment of the present invention. In an embodiment of the present invention, a length of the side face 604*b* may be 6 inches. The opening 610 may have a total length and a total width of 2.030 inches when the base covers 102*a*-102*b* are locked together by pushing the base covers 102*a*-102*b* horizontally towards each other.

Figure 6C:
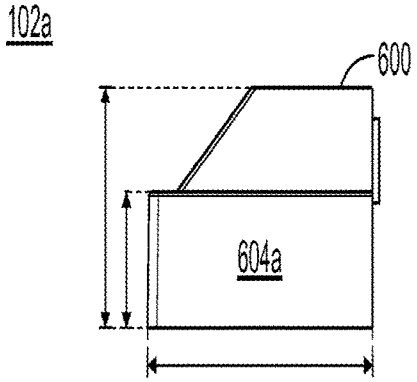

FIG. 6C illustrates a side view of the base cover 102*a*, according to an embodiment of the present invention. In an embodiment of the present invention, a length of the side face 604*a* and the side face 604*c* may be 3 inches. A height of each of the side faces 604*a*-604*c* may be 1 inch, in an embodiment of the present invention. Further, a total height of the base cover 102*a* may be 1.750 inches, in an embodiment of the present invention.

Figure 6D:
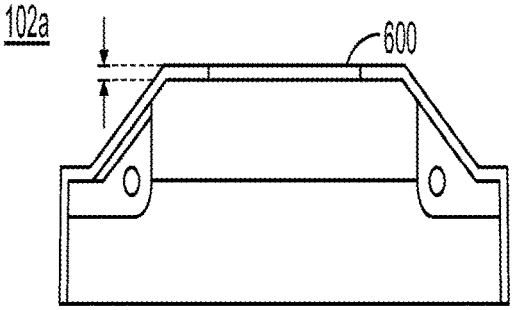

FIG. 6D illustrates a front view of the base cover 102*a*, according to an embodiment of the present invention. The base cover 102*a* may be made up of an aluminum 380.0-F having a thickness of 0.100 inch, in an embodiment of the present invention.

Figure 6F:
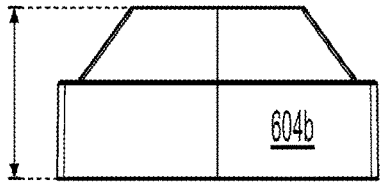
Figure 6E:
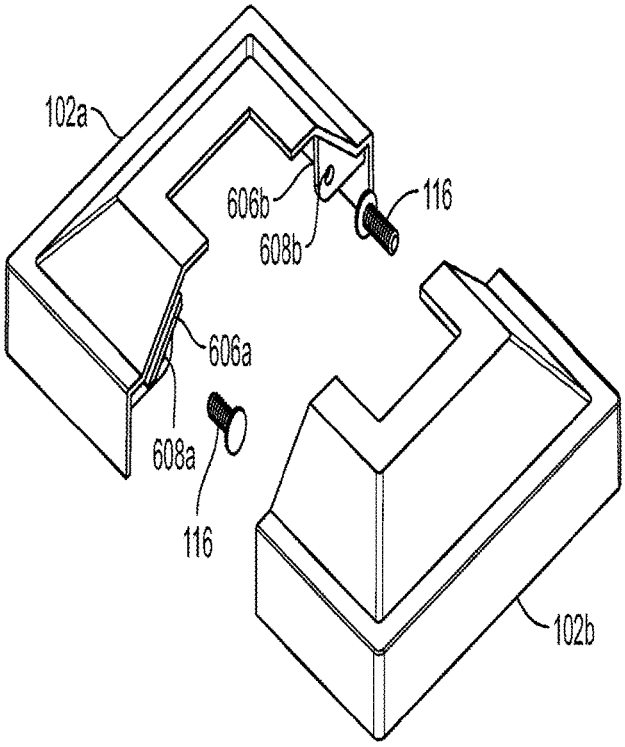

FIG. 6E illustrates a perspective view of the base covers 102*a*-102*b*, according to an embodiment of the present invention. The pin hole 608*a* of the pin lip 606*a* and the pin hole 608*b* of the pin lip 606*b* may be capable of accepting at least one attachment plug 116. Further, the base covers 102*a*-102*b* may be locked together by pushing the base covers 102*a*-102*b* horizontally towards each other.

FIG. 6F illustrates a side view of the base covers 102*a*-102*b* in an assembled position, according to an embodiment of the present invention.

Figure 6G:
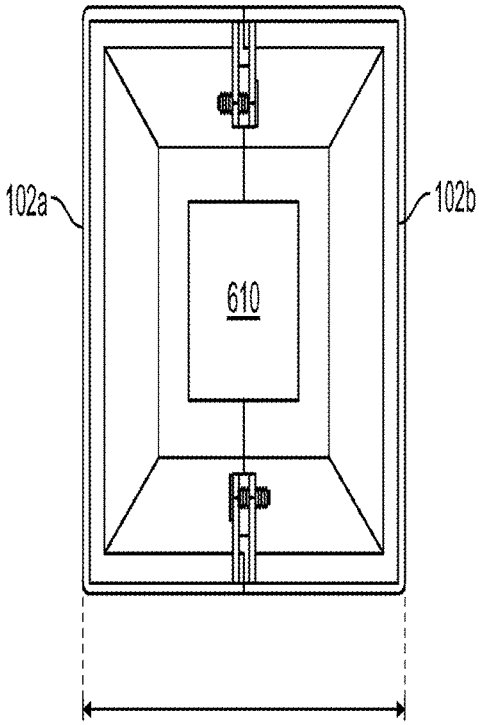

FIG. 6G illustrates a bottom view of the base covers 102*a*-102*b* in the assembled position, according to an embodiment of the present invention. The base covers 102*a*-102*b* may be locked together by pushing the base covers 102*a*-102*b* horizontally towards each other. Further, a total width of the assembled base covers 102-102*b* may be 6 inches, according to an embodiment of the present invention. Furthermore, the opening 610 of the assembled base covers 102*a*-102*b* may have a total length and a total width of 2.030 inches, in an embodiment of the present invention.

Figure 7A:
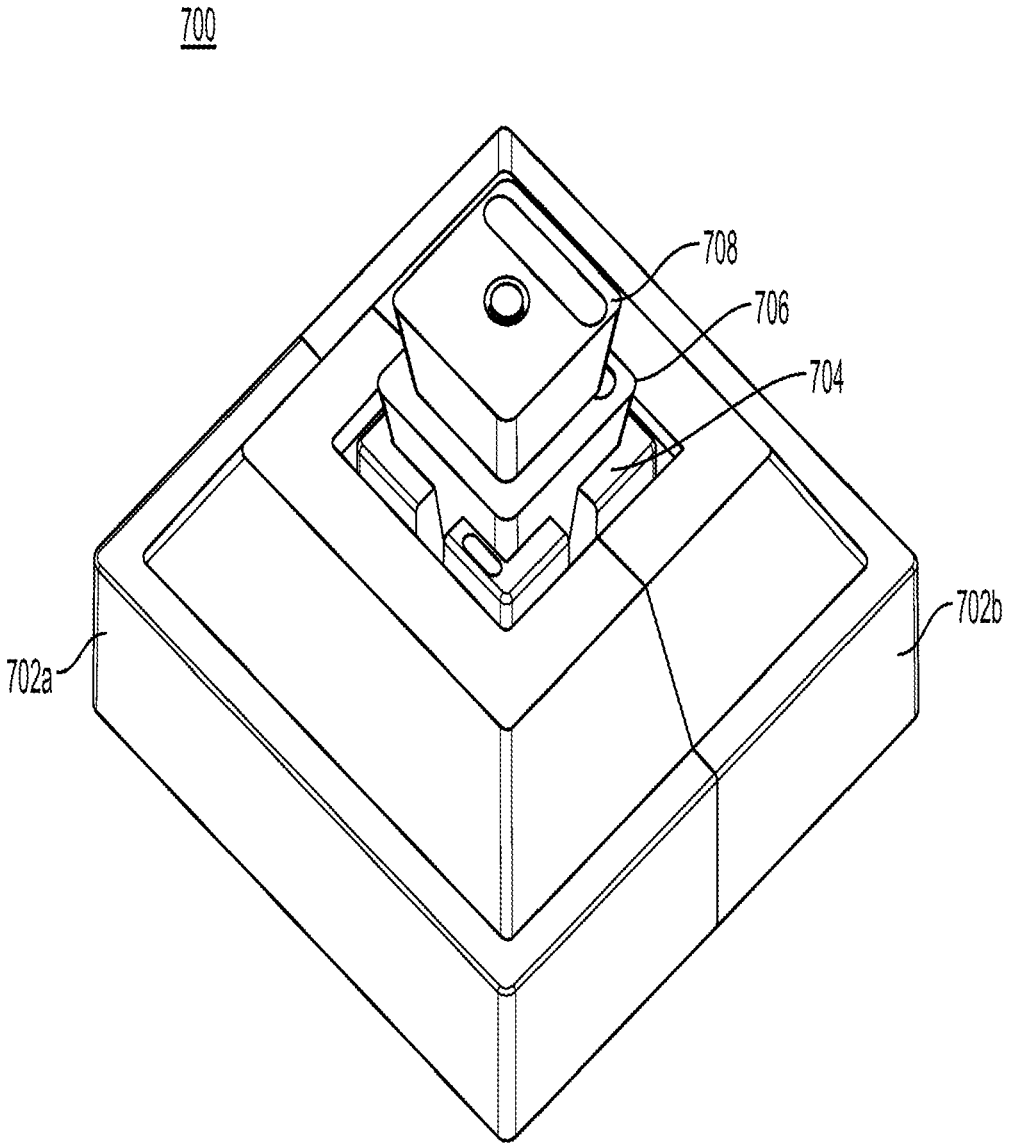
FIG. 7A illustrates an assembled perspective view of a fence post mount device to mount a 2.5 inches post, according to an embodiment of the present invention disclosed herein.

FIG. 7A illustrates an assembled perspective view of a fence post mount device 700 to mount a 2.5 inches post, according to an embodiment of the present invention. The fence post mount device 700 comprises base covers 702*a*-702*b*, a second universal collet 704, a third cap nut 706, and a fourth cap nut 708, according to an embodiment of the present invention. The base covers 702*a*-702*b*, the second universal collet 704, the third cap nut 706, and the fourth cap nut 708 may be made up of material such as, but not limited to, an aluminum alloy, a steel alloy, a copper-based alloy, a magnesium alloy, a zinc alloy, and so forth. In a preferred embodiment of the present invention, the base covers 702*a*-702*b*, the second universal collet 704, the third cap nut 706 and the fourth cap nut 708 may be made up of an aluminum 380.0-F. Embodiments of the present invention are intended to include or otherwise cover any type of the material including known, related art, and/or later developed technologies.

In an embodiment of the present invention, the base covers 702*a*-702*b* may be used to cover the fence post mount device 700 when assembled and mounted on a surface. According to embodiments of the present invention, the surface may be, but not limited to, a ground, a footpath, a floor, and so forth. Embodiments of the present invention are intended to include or otherwise cover any type of the surface including known, related art, and/or later developed technologies.

Figure 7B:
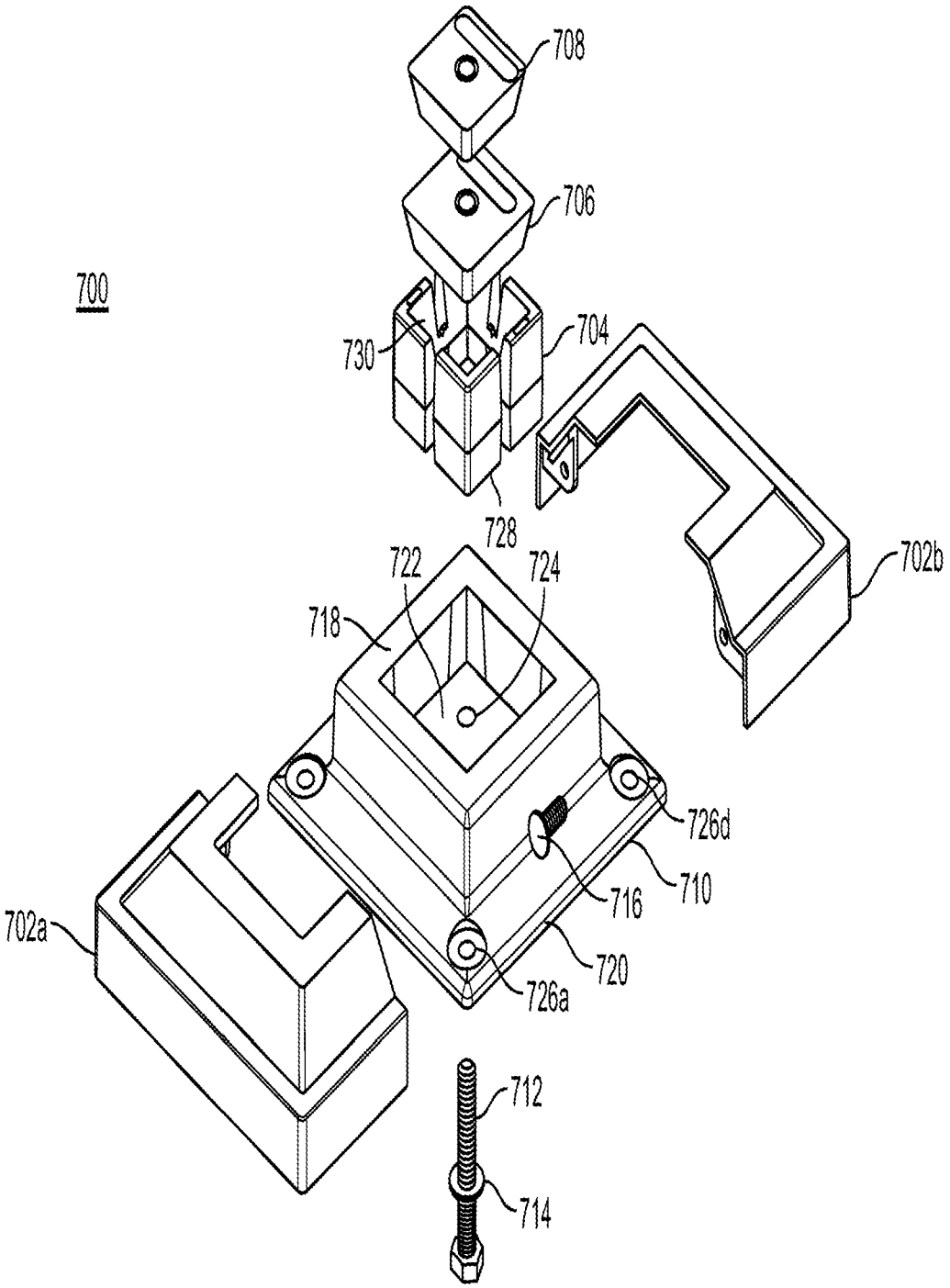
FIG. 7B illustrates an exploded perspective view of the fence post mount device to mount the 2.5 inches post, according to an embodiment of the present invention disclosed herein.

FIG. 7B illustrates an exploded perspective view of the fence post mount device 700 to mount the 2.5 inches post, according to an embodiment of the present invention. The fence post mount device 700 comprises the base covers 702*a*-702*b*, the second universal collet 704, the third cap nut 706, the fourth cap nut 708, a base 710, a full thread nut 712, a washer 714, and an attachment plug 716. According to an embodiment of the present invention, the base 710 may comprise a proximal end 718 and a distal end 720. The proximal end 718 of the base 710 may further comprise a cavity 722 that may be provided to accept the second universal collet 704. According to embodiments of the present invention, a shape of the cavity 722 may be, but not limited to, a rectangle, a square, a circle, and so forth. In an embodiment of the present invention, the shape of the cavity 722 may be according to a shape of a post that may be required to be mounted using the fence post mount device 700.

The distal end 720 of the base 710 may comprise an opening 724 for accepting the full thread nut 712, in an embodiment of the present invention. The full thread nut 712 may be configured to be threaded into the third cap nut 706, in an embodiment of the present invention. In another embodiment of the present invention, the full thread nut 712 may be configured to be threaded into the fourth cap nut 708 through the washer 714. Further, the base 710 may comprise attachment grooves 726*a*-726*d* (hereinafter referred to as the attachment grooves 726) at each corner of the base 710. The attachment grooves 726 may be designed to accept at least one of attachment tool (not shown), according to embodiments of the present invention. According to embodiments of the present invention, the attachment tool may be for example, but not limited to, a screw, a nail, a nut, and so forth. Embodiments of the present invention are intended to include or otherwise cover any type of the attachment tools including known, related art, and/or later developed technologies that may be capable of securing the base 710 on the surface.

According to embodiments of the present invention, the second universal collet 704 may comprise a distal end 728 and a proximal end 730. In an exemplary scenario, if a 2.5 inches×1/16 inches post is to be mounted using the fence post mount device 700, then the distal end 728 of the second universal collet 704 may be inserted into the cavity 722 of the base 710. The third cap nut 706 may be inserted from the proximal end 730 of the second universal collet 704. Further, the 2.5 inches×1/16 inches post may be inserted into the cavity 722 such that the 2.5 inches×1/16 inches post circumscribes the second universal collet 704, in an embodiment of the present invention. Furthermore, the full thread nut 712 may be inserted through the opening 724 provided at the distal end 720 of the base 710 and threaded into the third cap nut 706, according to an embodiment of the present invention. In other embodiments, the post will be greater than or less than 2.5 inches×1/16 inches.

In another exemplary scenario, if a 2.5 inches×1/8 inches post is to be mounted using the fence post mount device 700, then the proximal end 730 of the second universal collet 704 may be inserted into the cavity 722 of the base 710. In other exemplary scenarios, the post dimensions will be greater than or less than 2.5 inches×1/8 inches. Further, the fourth cap nut 708 may be inserted from the distal end 728 of the second universal collet 704. Furthermore, the 2.5 inches×1/8 inches post may be inserted into the cavity 722 such that the 2.5 inches×1/8 inches post circumscribes the second universal collet 704, in an embodiment of the present invention. According to an embodiment of the present invention, the full thread nut 712 may be inserted through the opening 724 provided at the distal end 720 of the base 710 and threaded into the fourth cap nut 708, according to an embodiment of the present invention.

According to embodiments of the present invention, the base covers 702*a*-702*b* may be used to cover the base of the fence post mount device 700 when assembled and mounted on a surface. The base covers 702*a*-702*b* may be attached to each other using the attachment plug 716, as discussed in the FIG. 7A. In an embodiment of the present invention, the attachment plug 716 may be, but not limited to, a plastic push pin, a polyvinyl plug, a plastic plug, and so forth. In an embodiment of the present invention, the attachment plug 716 may be a snap lock plug that may be capable of locking the base covers 702*a*-702*b* when the base covers 702*a*-702*b* are pushed horizontally towards each other. Embodiments of the present invention are intended to include or otherwise cover any type of the attachment plug 716 including known, related art, and/or later developed technologies that may be capable of attaching the base covers 702*a*-702*b*.

Figure 7C:
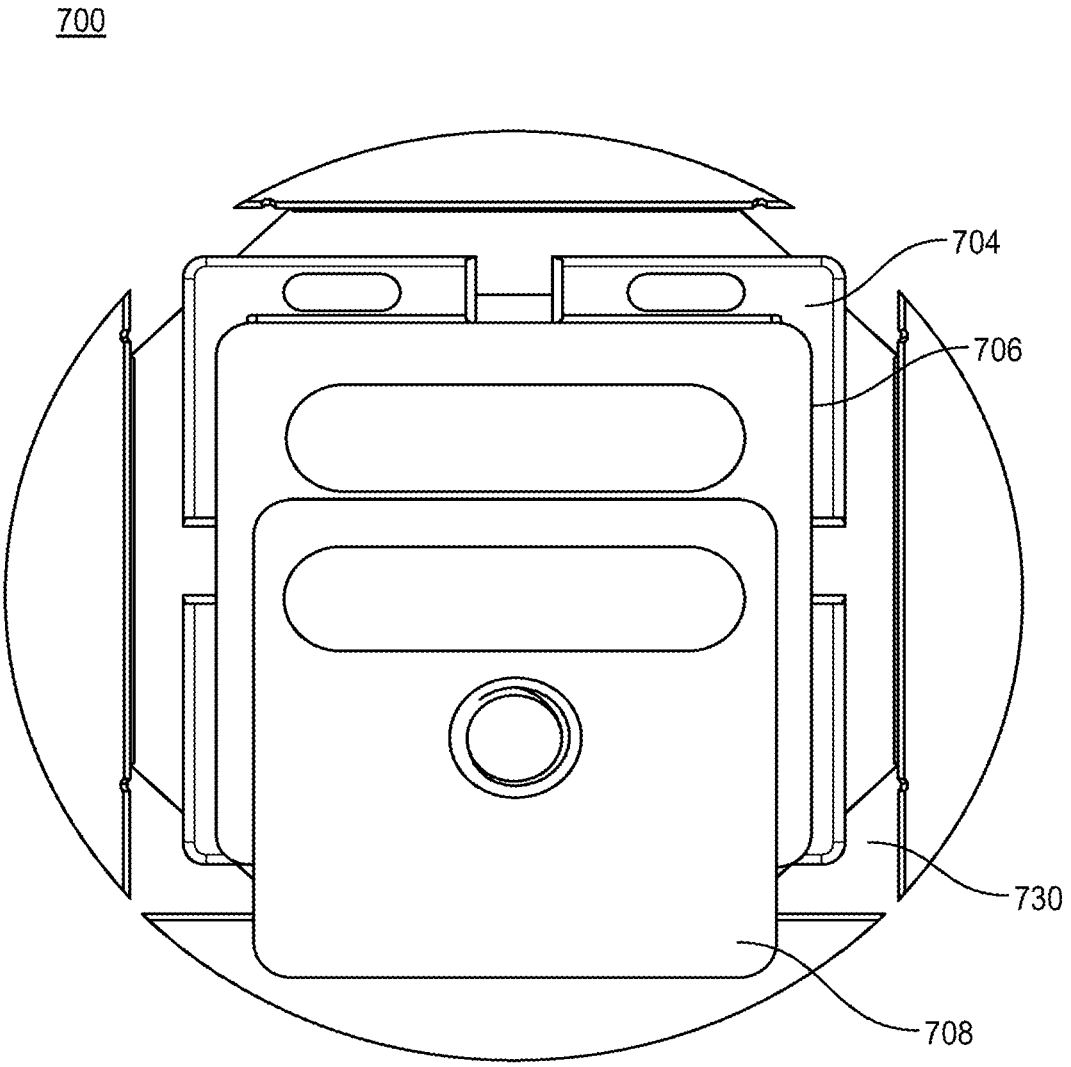
FIG. 7C illustrates an enlarged top view of the fence post mount device to mount the 2.5 inches post, according to an embodiment of the present invention disclosed herein.

FIG. 7C illustrates an enlarged top view of the fence post mount device 700 to mount the 2.5 inches post, according to an embodiment of the present invention. The distal end 728 of the second universal collet 704 may be inserted into the cavity 722 of the base 710, in an embodiment of the present invention. Further, the proximal end 730 of the second universal collet 704 may be designed to receive the third cap nut 706, in an embodiment of the present invention.

Figure 8A:
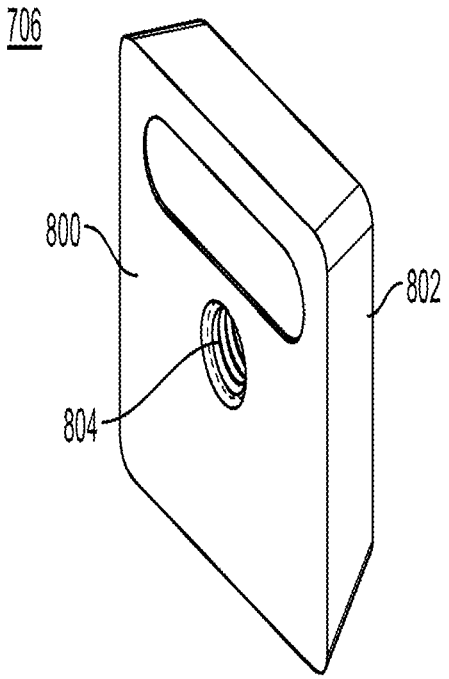
FIGS. 8A-8D illustrate different views of a third cap nut of the fence post mount device to mount the 2.5 inches post, according to an embodiment of the present invention disclosed herein.

FIGS. 8A-8D illustrate different views of the third cap nut 706 of the fence post mount device 700 to mount the 2.5 inches post, according to an embodiment of the present invention. FIG. 8A illustrates a perspective view of the first cap nut 806, according to an embodiment of the present invention. The third cap nut 706 may be a 2.5 inches×1/16 inches cap nut designed to be used for mounting the 2.5 inches×1/16 inches post (not shown). In other embodiments, the dimensions of the third cap nut 706 and post will be greater than or less than 2.5 inches×1/16 inches. The third cap nut 706 may comprise a proximal end 800, a distal end 802 and a longitudinal groove 804, according to an embodiment of the present invention. In an embodiment of the present invention, a width of the proximal end 800 of the third cap nut 706 may be greater than a width of the distal end 802 of the third cap nut 706. Further, the third cap nut 706 may be made up of a material such as, but not limited to, an aluminum alloy, a steel alloy, a copper-based alloy, a magnesium alloy, a zinc alloy, and so forth. In a preferred embodiment of the present invention, the third cap nut 706 may be made up of an aluminum 380.0-F. In an embodiment of the present invention, a shape of the third cap nut 706 may be trapezoid.

Figure 8B:
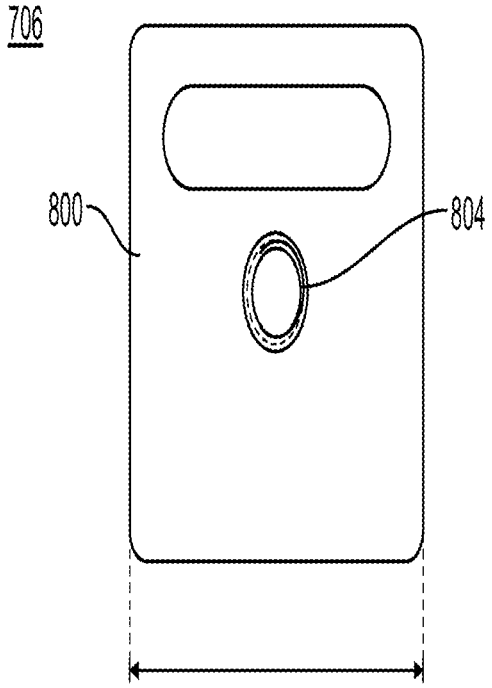

FIG. 8B illustrates a top view of the third cap nut 706, according to an embodiment of the present invention. A width of the proximal end 800 of the third cap nut 706 may be 1.950 inches, in an embodiment of the present invention. Further, the longitudinal groove 804 may be provided at a center of the proximal end 800 of the third cap nut 706. The longitudinal groove 804 may be a threaded groove that may be capable of accepting the full thread nut 712, according to embodiments of the present invention. Further, the proximal end 800 of the third cap nut 706 may have curved edges at each corner. The curved edges may have a true radius of 0.125 mm, in an embodiment of the present invention.

Figure 8C:
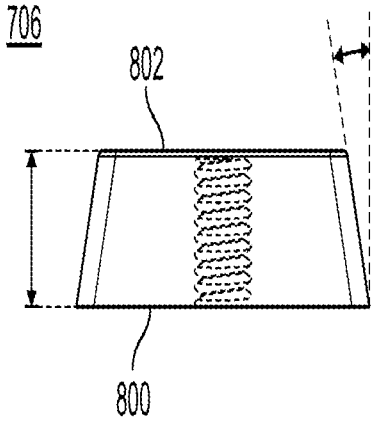

FIG. 8C illustrates a cross-sectional side view of the third cap nut 706, according to an embodiment of the present invention. A height of the third cap nut 706 may be 0.563 inches, in an embodiment of the present invention. Further, the third cap nut 706 may comprise sides that may be slanted from the proximal end 800 towards the distal end 802 of the third cap nut 706. The angle of each of the slanted sides may be 15° with respect to a vertical axis of the third cap nut 706, according to an embodiment of the present invention.

Figure 8D:
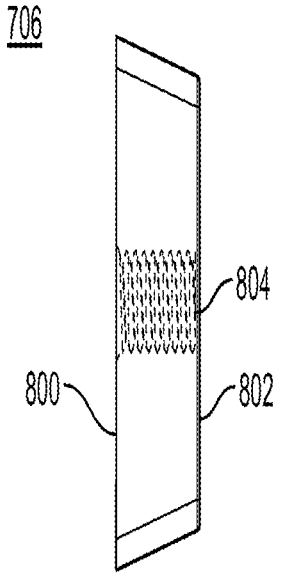

FIG. 8D illustrates a cross-sectional side view of the third cap nut 706, according to an embodiment of the present invention. The distal end 802 of the third cap nut 706 may have curved edge at a junction where the slanted sides of the third cap nut 706 meets with the distal end 802 of the third cap nut 706. The curved edge may have a radius of 0.015 mm, in an embodiment of the present invention. Further, the longitudinal groove 804 may have a class 2B UNC thread having a nominal size and thread per inch of ⅜-16, in an embodiment of the present invention.

Figure 9A:
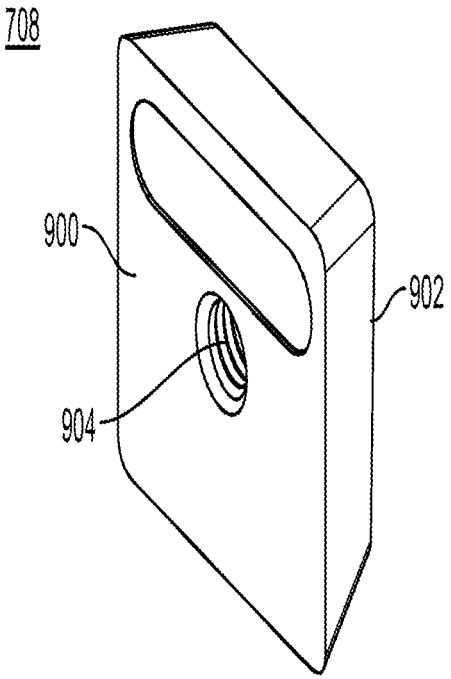
FIGS. 9A-9D illustrate different views of a fourth cap nut of the fence post mount device to mount the 2.5 inches post, according to an embodiment of the present invention disclosed herein.

FIGS. 9A-9D illustrate different views of the fourth cap nut 708 of the fence post mount device 700 to mount the 2.5 inches post, according to an embodiment of the present invention. FIG. 9A illustrates a perspective view of the fourth cap nut 708, according to an embodiment of the present invention. The fourth cap nut 708 may be a 2.5 inches×⅛ inches cap nut designed to be used for mounting a 2.5 inches×⅛ inches post. In other exemplary scenarios, the dimensions of the fourth cap nut 708 are greater than or less than 2.5 inches×⅛ inches. The fourth cap nut 708 may comprise a proximal end 900, a distal end 902 and a longitudinal groove 904, according to an embodiment of the present invention. In an embodiment of the present invention, a width of the proximal end 900 of the fourth cap nut 708 may be greater than a width of the distal end 902 of the fourth cap nut 708. Further, the fourth cap nut 708 may be made up of a material such as, but not limited to, an aluminum alloy, a steel alloy, a copper-based alloy, a magnesium alloy, a zinc alloy, and so forth. In a preferred embodiment of the present invention, the fourth cap nut 708 may be made up of an aluminum 380.0-F. In an embodiment of the present invention, a shape of the fourth cap nut 708 may be trapezoid.

Figure 9B:
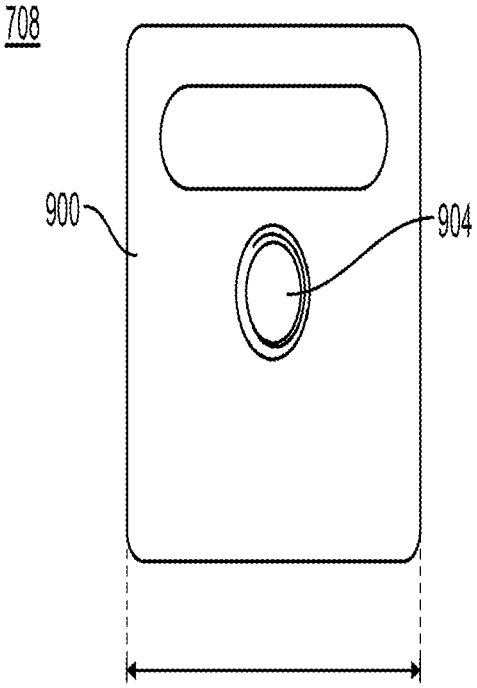

FIG. 9B illustrates a top view of the fourth cap nut 708, according to an embodiment of the present invention. The width of the proximal end 900 of the fourth cap nut 708 may be 1.710 inches, in an embodiment of the present invention. Further, the longitudinal groove 904 may be provided at a center of the proximal end 900 of the fourth cap nut 708. The longitudinal groove 904 may be a threaded groove that may be capable of accepting the full thread nut 712, according to embodiments of the present invention. Further, the proximal end 900 of the fourth cap nut 708 may include curved edges at each corner. The curved edges may have a true radius of 0.125 mm, in an embodiment of the present invention.

Figure 9C:
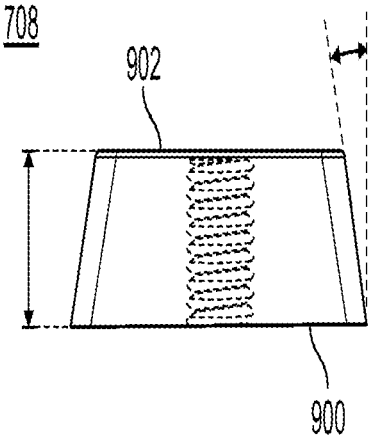

FIG. 9C illustrates a cross-sectional side view of the fourth cap nut 708, according to an embodiment of the present invention. A height of the fourth cap nut 708 may be 0.563 inches, in an embodiment of the present invention. Further, the fourth cap nut 708 may comprise sides that may be slanted from the proximal end 900 towards the distal end 902. The angle of each of the slanted sides may be 15° with respect to a vertical axis of the fourth cap nut 708, according to an embodiment of the present invention.

Figure 9D:
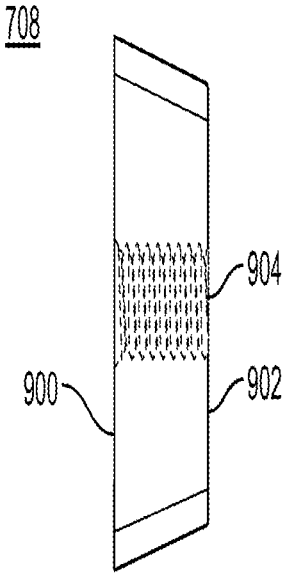

FIG. 9D illustrates a cross-sectional side view of the fourth cap nut 708, according to an embodiment of the present invention. The distal end 902 of the fourth cap nut 708 may have a curved edge at a junction where the slanted sides of the fourth cap nut 708 meets with the distal end 902 of the fourth cap nut 708. The curved edge may have a radius of 0.015 mm, in an embodiment of the present invention. Further, the longitudinal groove 904 may have a class 2B UNC thread having a nominal size and thread per inch of ⅜-16, in an embodiment of the present invention.

Figure 10A:
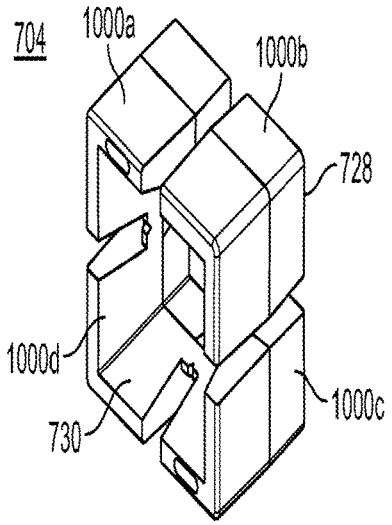
FIGS. 10A-10F illustrate different views of a second universal collet of the fence post mount device to mount the 2.5 inches post, according to an embodiment of the present invention disclosed herein.

FIGS. 10A-10F illustrate different views of the second universal collet 704 of the fence post mount device 700 to mount the 2.5 inches post, according to embodiments of the present invention. FIG. 10A illustrates a perspective view of the second universal collet 704, according to an embodiment of the present invention. The second universal collet 704 may comprise collet legs 1000*a*-1000*d* (hereinafter referred to as the collet leg 1000), according to embodiments of the present invention. According to embodiments of the present invention, each of the collet leg 1000 may be a L-shaped leg attached to the adjacent collet leg 1000 to form a rectangular shaped first universal collet 704 having an opening at both the distal end 728 and the proximal end 730.

Figure 10B:
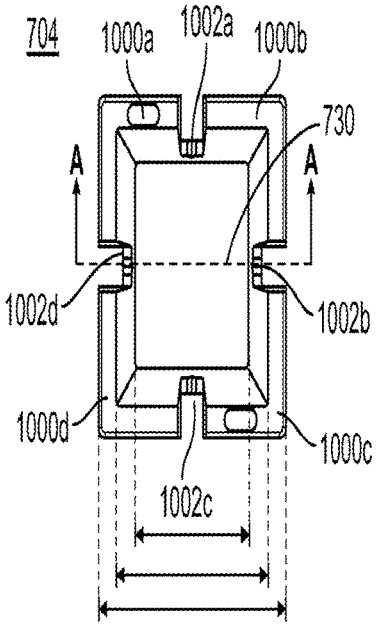

FIG. 10B illustrates a side perspective view of the second universal collet 704, according to an embodiment of the present invention. Each of the collet leg 1000 may be attached to the adjacent collet leg 1000 through at least one of a separation notches 1002*a*-1002*d*, according to embodiments of the present invention. According to embodiments of the present invention, each of the collet leg 1000 may have a slanted inner wall that may extend vertically downwards from the proximal end 730 to a transition point 1004. A length of the slanted inner wall from a surface of the proximal end 730 to the transition point 1004 may be 0.836 inches (as shown in FIG. 10D). According to embodiments of the present invention, each of the collet leg 1000 may have a slanted inner wall that may extend vertically downwards from the distal end 728 to the transition point 1004. A length of the slanted inner wall from a surface of the distal end 728 to the transition point 1004 may be 0.602 inches (as shown in FIG. 10D). Further, an angle of each of the slanted inner wall may be 15° with respect to a vertical axis of the universal collet 704, according to embodiments of the present invention. The proximal end 730 of the second universal collet 704 may be designed to receive the third cap nut 706 for mounting the 2.5 inches×1/16 inches post, according to an embodiment of the present invention. In other embodiments, the post will have dimensions greater than or less than 2.5 inches×1/16 inches. Further, an outer width of the second universal collet 704 may be 2.175 inches, in an embodiment of the present invention. An inner width of the second universal collet 704 at the surface of the proximal end 730 may be 1.750 inches, in an embodiment of the present invention. Furthermore, an inner width of the second universal collet 704 at the transition point may be 1.302 inches, according to embodiments of the present invention.

Figure 10C:
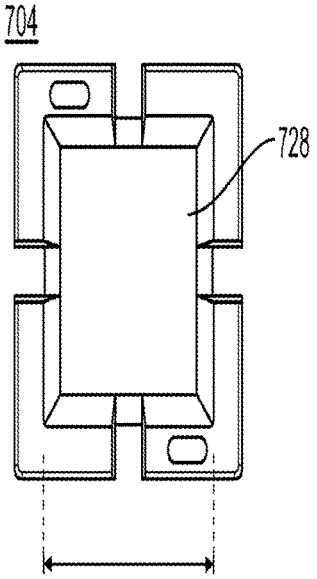
Figure 10D:
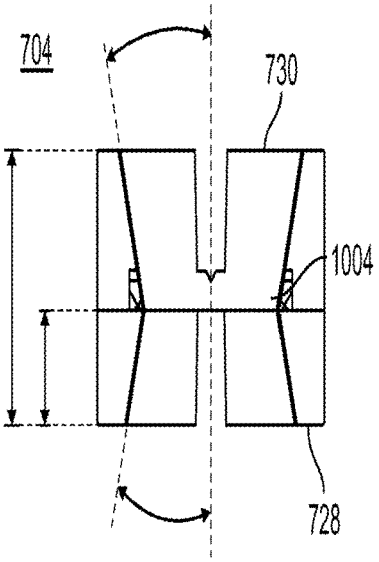

FIG. 10C illustrates a bottom view of the second universal collet 704, according to an embodiment of the present invention. The distal end 728 of the second universal collet 704 may be designed to receive the fourth cap nut 708 for mounting the 2.5 inches×⅛ inches post, according to an embodiment of the present invention. In other embodiments, the fourth cap nut 708 can have dimensions that are greater than or less than 2.5 inches×⅛ inches. An inner width of the second universal collet 704 at the surface of the distal end 728 may be 1.625 inches, in an embodiment of the present invention.

FIG. 10D illustrates a side view of the second universal collet 704, according to an embodiment of the present invention. According to embodiments of the present invention, each of the collet leg 1000 may have a slanted inner wall that may extend vertically downwards from the proximal end 730 to the transition point 1004, as discussed in the FIG. 10B. A length of the slanted inner wall from a surface of the proximal end 730 to the transition point 1004 may be 0.836 inches. According to embodiments of the present invention, each of the collet leg 1000 may have a slanted inner wall that may extend vertically downwards from the distal end 728 to the transition point 1004. A length of the slanted inner wall from a surface of the distal end 728 to the transition point 1004 may be 0.602 inches, in an embodiment of the present invention.

Figure 10E:
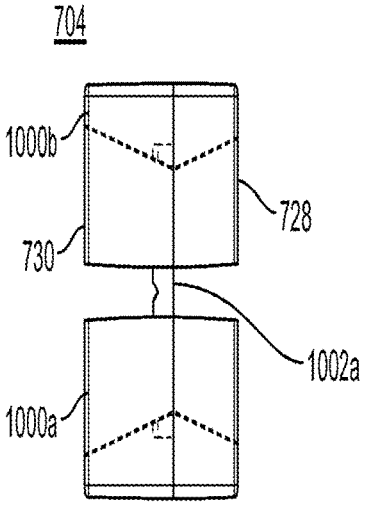

FIG. 10E illustrates a side perspective view of the second universal collet 704, according to an embodiment of the present invention. According to an embodiment of the present invention, the collet leg 1000*a* may be attached to the adjacent collet leg 1000*b* through the separation notch 1002*a*, according to embodiments of the present invention.

Figure 10F:
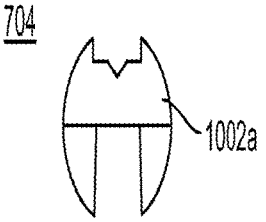

FIG. 10F illustrates an enlarged view of the separation notch 1002*a* of the second universal collet 704, according to an embodiment of the present invention. The separation notch 1002*a* may be a breakable notch that may be configured to be broken by a force applied by the collet leg 1000 on the slanted inner walls of the second universal collet 704 when the third cap nut 706 is tightened, in an embodiment of the present invention. In another embodiment of the present invention, the separation notch 1002*a* may be a breakable notch that may be configured to be broken by a force applied by the collet leg 1000 on the slanted inner walls of the second universal collet 704 when the fourth cap nut 708 is tightened.

Figure 11A:
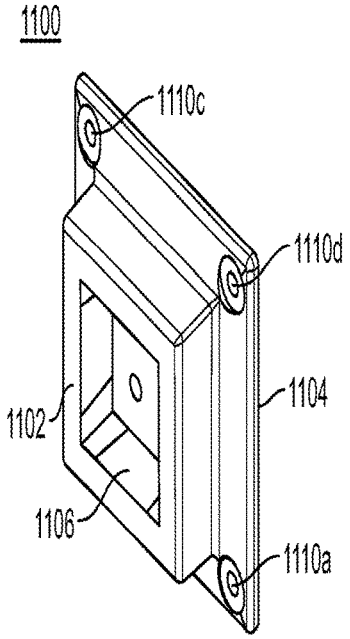
FIGS. 11A-11E illustrate different views of a base of the fence post mount device to mount the 2.5 inches post, according to an embodiment of the present invention disclosed herein.
Figure 11B:
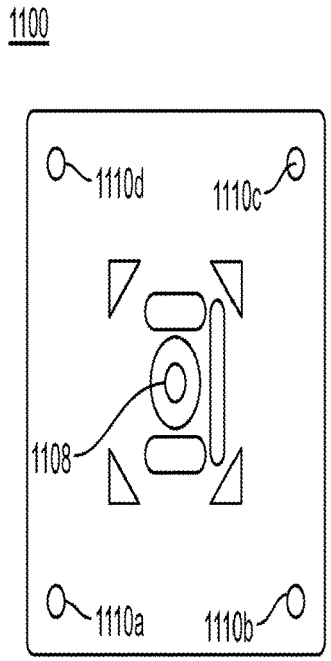

FIGS. 11A-11E illustrate different views of the base 1100 of the fence post mount device 700 to mount the 2.5 inches post, according to embodiments of the present invention. FIG. 11A illustrates a perspective view of the base 1100, according to an embodiment of the present invention. According to an embodiment of the present invention, the base 1100 may comprise a proximal end 1102 and a distal end 1104. The proximal end 1102 of the base 1100 may further comprise a cavity 1106 that may be provided to accept the second universal collet 704. According to embodiments of the present invention, a shape of the cavity 1106 may be, but not limited to, a rectangle, a square, a circle, and so forth. In an embodiment of the present invention, the shape of the cavity 1106 may be according to a shape of a post that may be required to be mounted using the fence post mount device 700. The distal end 1104 of the base 1100 may comprise an opening 1108 (as shown in FIG. 11B) for accepting the full thread nut 712, in an embodiment of the present invention. Further, the base 1100 may comprise attachment grooves 1110*a*-1110*d* (hereinafter referred to as the attachment grooves 1110) at each corner of the base 1100. The attachment grooves 1110 may be designed to accept at least one attachment tool (not shown) to attach the base 1100 with a surface, according to embodiments of the present invention. According to embodiments of the present invention, the base 1100 may be made up of a material such as, but not limited to, an aluminum alloy, a steel alloy, a copper-based alloy, a magnesium alloy, a zinc alloy, and so forth. In a preferred embodiment of the present invention, the base 1100 may be made up of an aluminum 380.0-F. Embodiments of the present invention are intended to include or otherwise cover any type of the material for the base 1100 including known, related art, and/or later developed technologies.

Figure 11C:
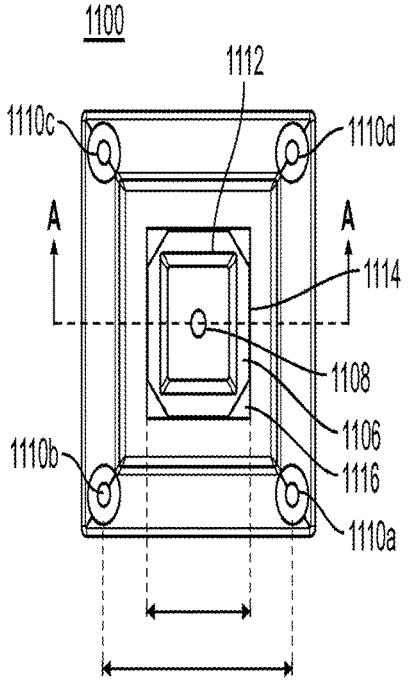

FIG. 11B illustrates a bottom view of the base 1100, according to an embodiment of the present invention. The distal end 1104 of the base 1100 may comprise the opening 1108 for accepting the full thread nut 712, in an embodiment of the present invention. In an embodiment of the present invention, a diameter of the opening 1108 may be 0.377 inches (as shown in FIG. 11C). Further, the base 1100 may comprise the attachment grooves 1110 at each corner of the base 1100. The attachment grooves 1110 may be designed to accept at least one attachment tool (not shown) to attach the base 1100 with a surface, according to embodiments of the present invention. In an embodiment of the present invention, a diameter of the attachment grooves 1110 may be 0.344 inches (as shown in the FIG. 11C).

FIG. 11C illustrates a top view of the base 1100, according to an embodiment of the present invention. The cavity 1106 of the base 1100 may include a support nut 1112, in an embodiment of the present invention. The support nut 1112 may have a shape similar to the third cap nut 706, in an embodiment of the present invention. In another embodiment of the present invention, the shape of the support nut 1112 may be similar to the fourth cap nut 708. Further, the support nut 1112 may be manufactured integrally with the cavity 1106 of the base 1100, in an embodiment of the present invention. In another embodiment of the present invention, the support nut 1112 may be manually attached during installation of a post using the fence post mount device 700.

Furthermore, the cavity 1106 may have an inner wall 1114 extending vertically downwards towards the distal end 1104 of the base 1100. In an embodiment of the present invention, each corner of the inner wall 1114 and a surface of the cavity 1106 along each of the corner may include an angled depression 1116. The angled depression 1116 may be capable of coring an outer wall of a post that is to be installed using the fence post mount device 700, according to embodiments of the present invention. Further, the angled depression 1116 may allow the second universal collet 704 to deform an inside of the post when tightened by using the full thread nut 712 thus securely locking the post inserted into the cavity 1106 of the base 1100, in an embodiment of the present invention. According to an embodiment of the present invention, a width of the cavity 1106 may be 2.530 inches. Further, a length between the two corresponding attachment grooves 1110 may be 4.625 inches, in an embodiment of the present invention.

Figure 11D:
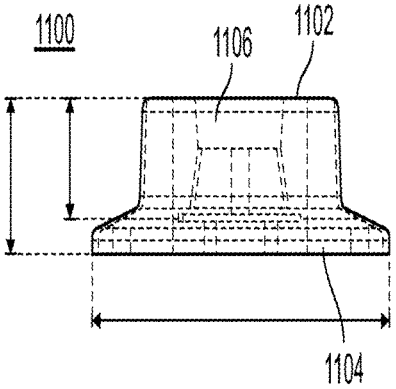

FIG. 11D illustrates a side view of the base 1100, according to an embodiment of the present invention. In an embodiment of the present invention, a total width of the base 1100 may be 5.750 inches. Further, a total height of the base 1100 from the proximal end 1102 to the distal end 1104 may be 1.625 inches. Furthermore, a height of the cavity 1106 may be 1.250 inches, according to an embodiment of the present invention.

Figure 11E:
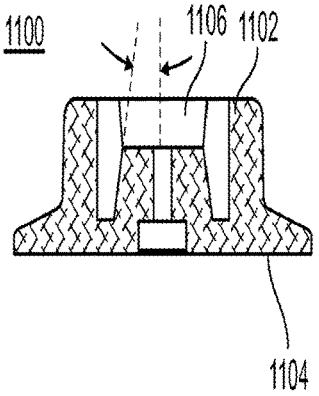

FIG. 11E illustrates a cross-sectional side view of the base 1100, according to an embodiment of the present invention. The cross-sectional view illustrates that the second universal collet 704 is inserted into the cavity 1106 of the base 1100.

Further, the second universal collet 704 is attached with a full thread nut 712 inserted into the base 1100 from the distal end 1104 of the base 1100.

Figure 12A:
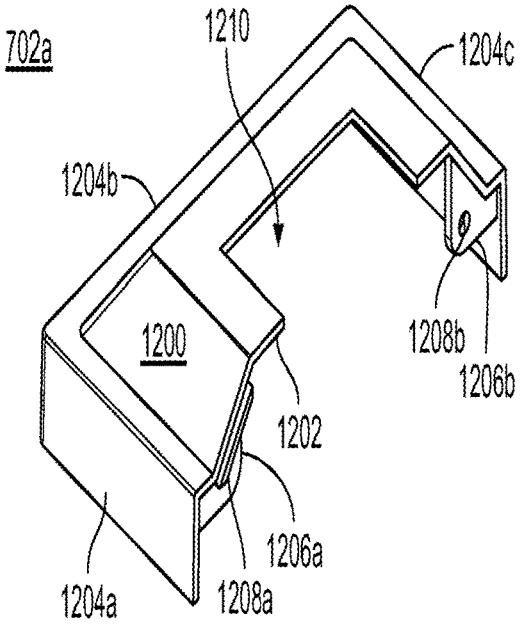
FIGS. 12A-12G illustrate different views of base covers of the fence post mount device to mount the 2.5 inches post, according to embodiments of the present invention disclosed herein.

FIGS. 12A-12G illustrate different views of the base covers 702*a*-702*b* of the fence post mount device 700 to mount the 2.5 inches post, according to embodiments of the present invention. FIG. 12A illustrates a perspective view of the base cover 702*a* of the base covers 702*a*-702*b*, according to an embodiment of the present invention. The base cover 702*a* may comprise a top surface 1200, a bottom surface 1202, side faces 1204*a*-1204*c* and pin lips 1206*a*-1206*b*, according to embodiments of the present invention. Further, the pin lip 1206*a* may comprise a pin hole 1208*a* and the pin lip 1206*b* may comprise a pin hole 1208*b*. The pin hole 1208*a* and the pin hole 1208*b* may be capable of accepting the attachment plug 716 (as shown in the FIG. 7B). As discussed, the attachment plug 716 may be, but not limited to, a plastic push pin, a polyvinyl plug, a plastic plug, and so forth. Embodiments of the present invention are intended to include or otherwise cover any type of the attachment plug 716 including known, related art, and/or later developed technologies that may be capable of attaching the base covers 702*a*-702*b*.

Further, the top surface 1200 of the base cover 702*a* may comprise an opening 1210 that may be designed to accommodate a 2.5 inches post, in an embodiment of the present invention. According to embodiments of the present invention, the base covers 702*a*-702*b* may be made up of a material such as, but not limited to, an aluminum alloy, a steel alloy, a copper-based alloy, a magnesium alloy, a zinc alloy, and so forth. Embodiments of the present invention are intended to include or otherwise cover any type of the material for the base covers 702*a*-702*b* including known, related art, and/or later developed technologies.

Figure 12B:
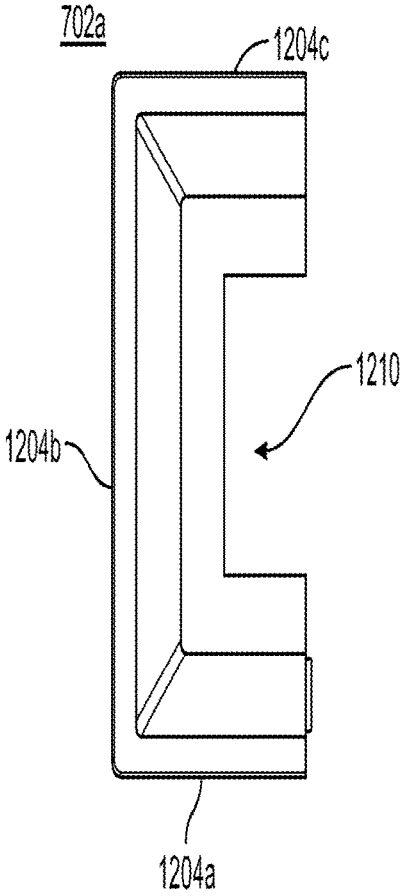

FIG. 12B illustrates a top view of the base cover 702*a*, according to an embodiment of the present invention. In an embodiment of the present invention, a length of the side face 1204*b* may be 6 inches. The opening 1210 may have a total length and a total width of 2.530 inches when the plurality of base covers 702*a*-702*b* are locked together by pushing the base covers 702*a*-702*b* horizontally towards each other.

Figure 12C:
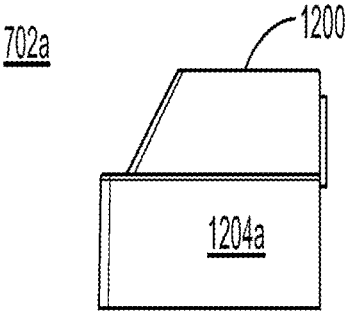

FIG. 12C illustrates a side view of the base cover 702*a*, according to an embodiment of the present invention. In an embodiment of the present invention, a length of the side face 1204*a* and the side face 1204*c* may be 3 inches. A height of each of the side faces 1204*a*-1204*c* may be 1 inch, in an embodiment of the present invention. Further, a total height of the base cover 702*a* may be 1.750 inches, in an embodiment of the present invention.

Figure 12D:
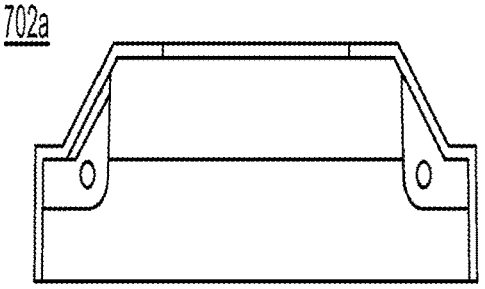

FIG. 12D illustrates a front view of the base cover 702*a*, according to an embodiment of the present invention. The base cover 702*a* may be made up of an aluminum 380.0-F having a thickness of 0.100 inch, in an embodiment of the present invention.

Figure 12F:
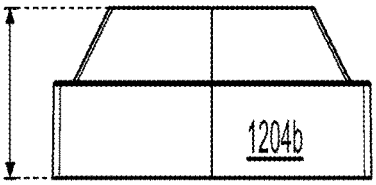
Figure 12E:
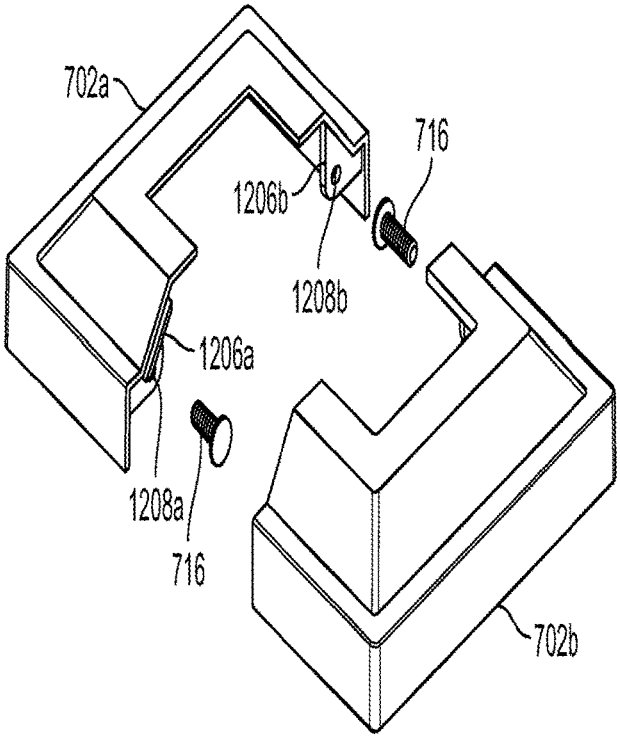

FIG. 12E illustrates a perspective view of the base covers 702*a*-702*b*, according to an embodiment of the present invention. The pin hole 1208*a* of the pin lip 1206*a* and the pin hole 1208*b* of the pin lip 1206*b* may be capable of accepting the attachment plug 716. Further, the base covers 702*a*-702*b* may be locked together by pushing the base covers 702*a*-702*b* horizontally towards each other.

FIG. 12F illustrates a side view of the base covers 702*a*-702*b* in an assembled position, according to an embodiment of the present invention.

Figure 12G:
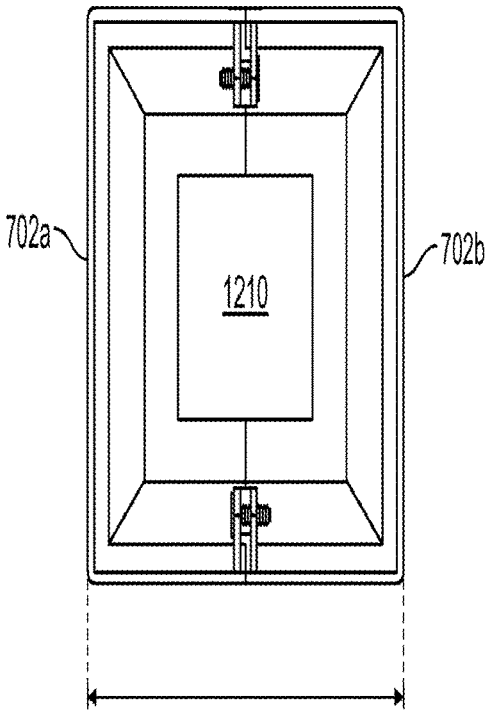

FIG. 12G illustrates a bottom view of the base covers 702*a*-702*b* in an assembled position, according to an embodiment of the present invention. The base covers 702*a*-702*b* may be locked together by pushing the base covers 702*a*-702*b* horizontally towards each other. Further, a total width of the assembled base covers 702-702*b* may be 6 inches, according to an embodiment of the present invention. Furthermore, the opening 1210 of the assembled base covers 702*a*-702*b* may have a total length and a total width of 2.530 inches, in an embodiment of the present invention.

Figure 13:
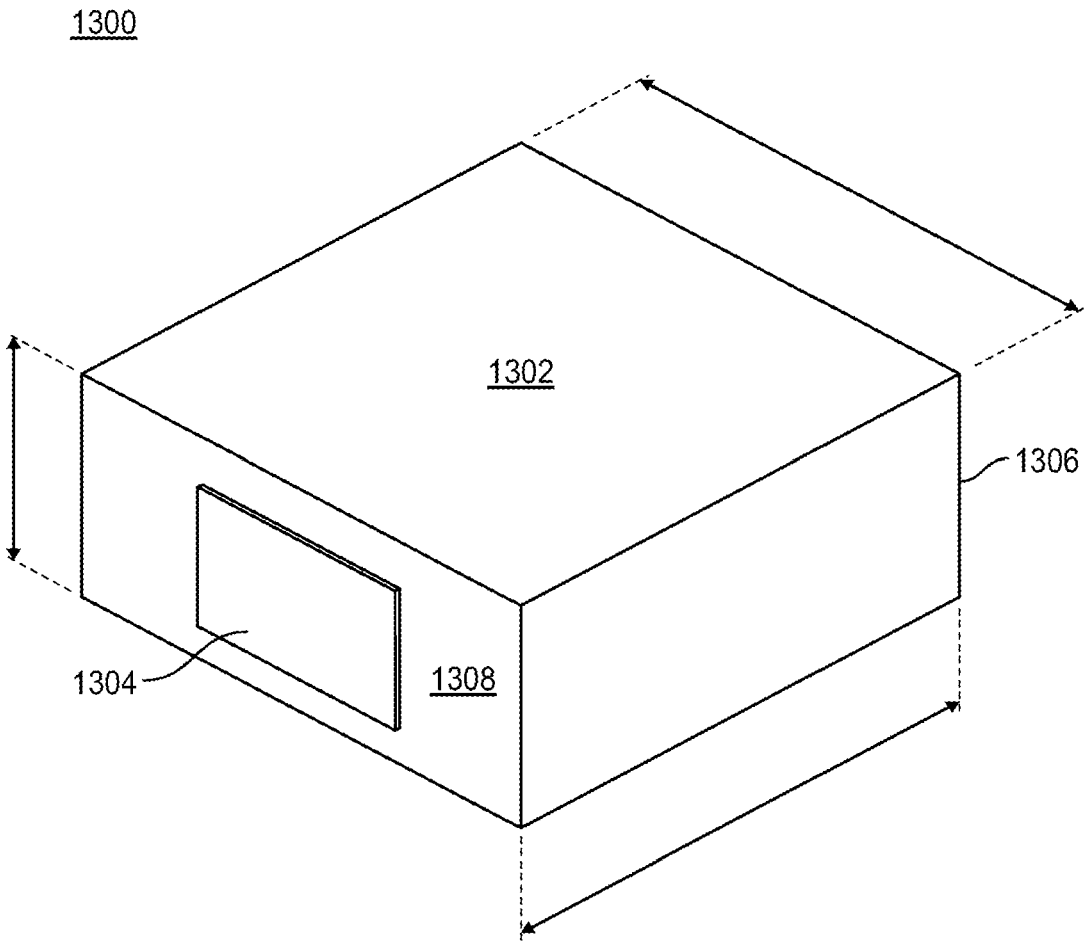
FIG. 13 illustrates a perspective view of a housing of the fence post mount device, according to an embodiment of the present invention disclosed herein.

FIG. 13 illustrates a perspective view of a housing 1300 of the fence post mount device 100 and/or the fence post mount device 700, according to an embodiment of the present invention. The housing 1300 may be used to enclose all components of the fence post mount device 100, in an embodiment of the present invention. The housing 1300 may be used to enclose all components of the fence post mount device 700, in another embodiment of the present invention. The housing 1300 may comprise a covering box 1302 and a label 1304. Further, the covering 1302 may comprise a proximal face 1306 and a distal face 1308. The covering box 1302 may be, but not limited to, a square box, a rectangular box, and so forth. Further, a length of the covering box 1302 may be 6.75 inches, in an embodiment of the present invention. Further, a height of the covering box 1302 may be 3.25 inches, in an embodiment of the present invention. According to an embodiment of the present invention, the label 1304 may be provided on the distal face 1308 of the housing 1300. In an embodiment for the present invention, the label 1304 may be used to display, but not limited to, a branding name, an assembly instruction, and so forth.

Figure 14A:
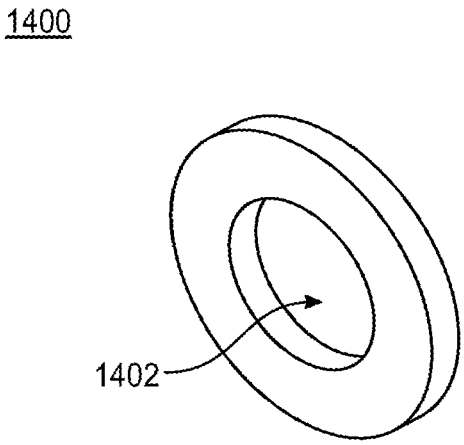
FIGS. 14A-14C illustrate different views of a washer of the fence post mount device, according to an embodiment of the present invention disclosed herein.
Figure 14B:
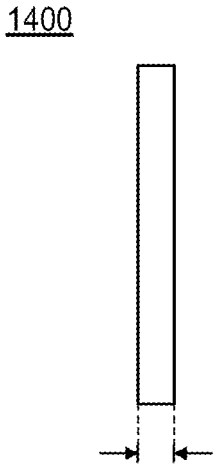
Figure 14C:
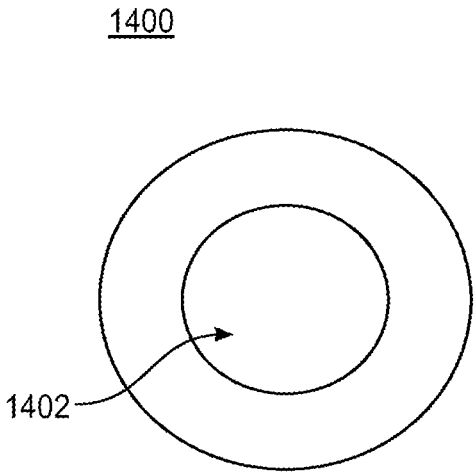

FIGS. 14A-14C illustrate different views of a washer 1400 of the fence post mount device 100 and/or the fence post mount device 700, according to an embodiment of the present invention. FIG. 14A illustrates a perspective view of the washer 1400, according to an embodiment of the present invention. The washer 1400 may be a circular washer having an opening 1402 at a center. The washer 1400 may be made up of a material such as, but not limited to, an aluminum alloy, a steel alloy, a copper-based alloy, a magnesium alloy, a zinc alloy, and so forth. Embodiments of the present invention are intended to include or otherwise cover any type of the material for the washer 1400 including known, related art, and/or later developed technologies.

FIG. 14B illustrates a side view of the washer 1400, according to an embodiment of the present invention. A width of the washer 1400 may be 0.07 inches, according to an embodiment of the present invention.

FIG. 14C illustrates a top view of the washer 1400 according to an embodiment of the present invention. A diameter of the opening 1402 of the washer 1400 may be 0.41 inches, in an embodiment of the present invention. Further, an outer diameter of the washer 1400 may be 0.73 inches, in an embodiment of the present invention.

Figure 15A:
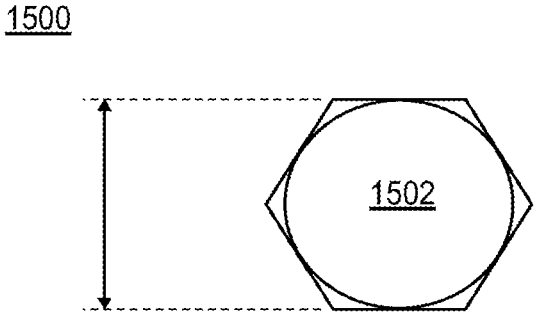
FIGS. 15A-15C illustrate different views of a full thread nut of the fence post mount device, according to embodiments of the present invention disclosed herein.
Figure 15B:
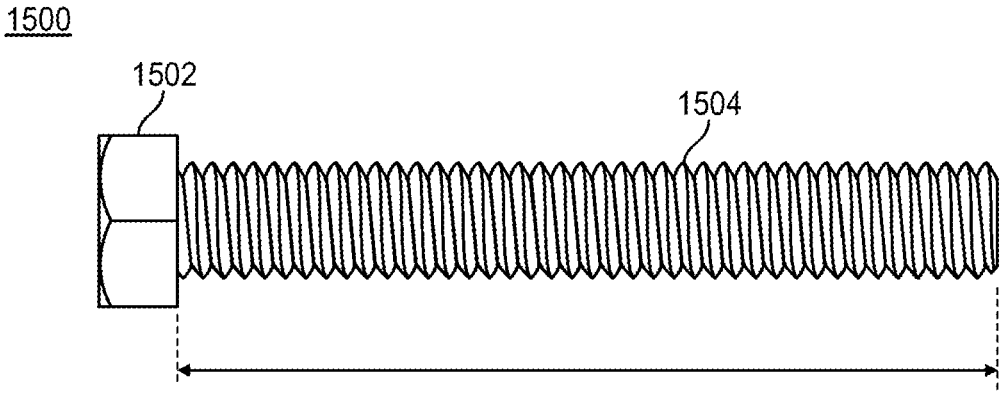
Figure 15C:
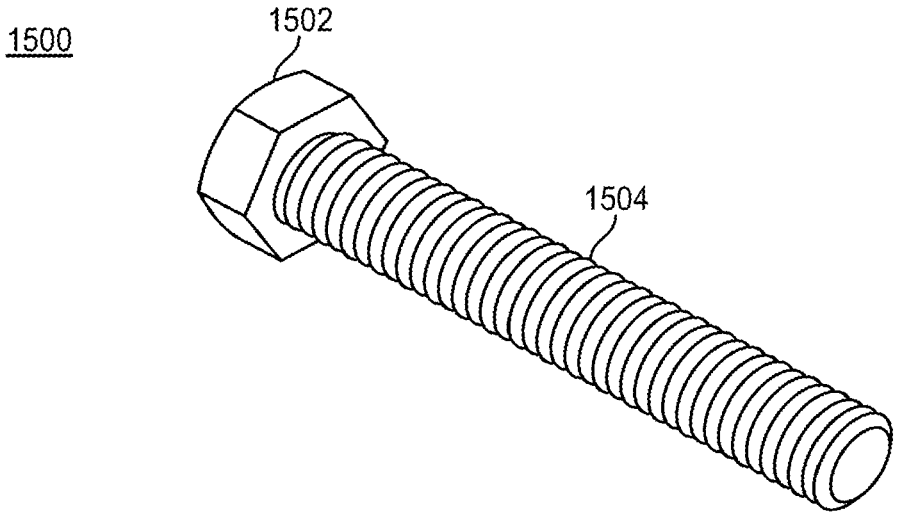

FIGS. 15A-15C illustrate different views of a full thread nut 1500 of the fence post mount device 100 and/or the fence post mount device 700, according to an embodiment of the present invention. FIG. 15A illustrates a top view of the full thread nut 1500, according to an embodiment of the present invention. The full thread nut 1500 may comprise a head 1502 and a body 1504 (as shown in FIG. 15B), according to an embodiment of the present invention. Further, a shape of the head 1502 may be, but not limited to, a hexagon, an octagon, a square, a pentagon, and so forth. Embodiments of the present invention are intended to include or otherwise cover any shape of the head 1502 including known, related art, and/or later developed technologies. According to an embodiment of the present invention, a width of the head 1502 may be 0.56 inches.

FIG. 15B illustrates a side view of the full thread nut 1500, according to an embodiment of the present invention. The full thread nut 1500 comprises the head 1502 and the body 1504. The body 1504 may comprise threads along a complete length of the body 1504, according to embodiments of the present invention. The threads may be a class 2B UNC thread having a nominal size and thread per inch of ⅜-16, in an embodiment of the present invention. Further, a length of the body 1504 may be 2.50 inches, according to an embodiment of the present invention.

FIG. 15C illustrates a perspective view of the full thread nut 1500 according to an embodiment of the present invention.

FIG. 16A illustrate a perspective view of a 2 inches post 1600, according to an embodiment of the present invention. The post 1600 may be a square-shaped post having a wall thickness of 0.0625 inches and a width of 2 inches, in an embodiment of the present invention. In another embodiment of the present invention, the post 1600 may be a square-shaped post having a wall thickness of 0.125 inches and a width of 2 inches. According to embodiments of the present invention, the post 1600 may be made up of a material such as, but not limited to, an aluminum alloy, a steel alloy, a copper-based alloy, a magnesium alloy, a zinc alloy, and so forth. Embodiments of the present invention are intended to include or otherwise cover any type of the material of the post 1600 including known, related art, and/or later developed technologies.

Figure 16B:
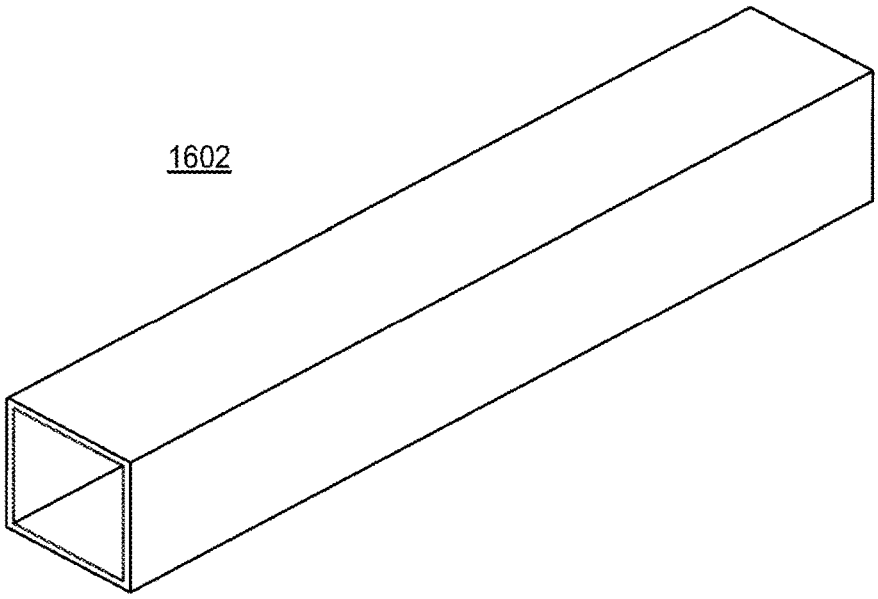
FIG. 16B illustrate a perspective view of a 2.5 inches post, according to another embodiment of the present invention.

FIG. 16B illustrate a perspective view of a 2.5 inches post 1602, according to another embodiment of the present invention. The post 1602 may be a square-shaped post having a wall thickness of 0.0625 inches and a width of 2.5 inches, in an embodiment of the present invention. In another embodiment of the present invention, the post 1602 may be a square-shaped post having a wall thickness of 0.125 inches and a width of 2.5 inches. According to embodiments of the present invention, the post 1602 may be made up of a material such as, but not limited to, an aluminum alloy, a steel alloy, a copper-based alloy, a magnesium alloy, a zinc alloy, and so forth. Embodiments of the present invention are intended to include or otherwise cover any type of the material of the post 1602 including known, related art, and/or later developed technologies.

Figure 17A:
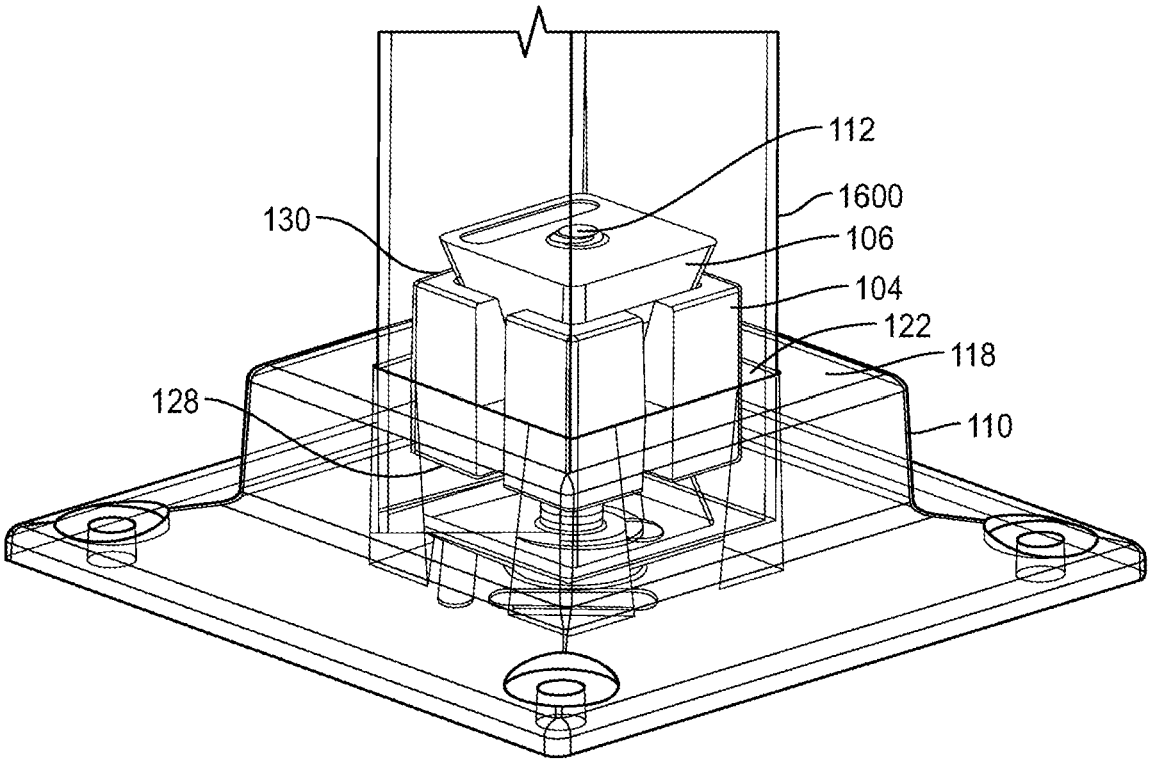
FIG. 17A illustrate an exemplary scenario of partially mounting a post by using the fence post mount device, according to an embodiment of the present invention disclosed herein.

FIG. 17A illustrate an exemplary scenario of partially mounting the post 1600 by using the fence post mount device 100, according to an embodiment of the present invention. The proximal end 118 of the base 110 may include the cavity 122 that may be provided to accept the first universal collet 104. In an embodiment of the present invention, the distal end 128 of the first universal collet 104 may be inserted into the cavity 122 of the base 110. Further, the first cap nut 106 may be inserted from the proximal end 130 of the first universal collet 104. Furthermore, a 2 inches×1/16 inches post may be inserted into the cavity 122 such that the 2 inches×1/16 inches post circumscribes the first universal collet 104, in an embodiment of the present invention. In other embodiments, the dimensions of the post will be greater than or less than 2 inches×1/16 inches. In an embodiment of the present invention, the full thread nut 112 may be inserted through the opening 124 provided at the distal end 120 of the base 110 and threaded into the first cap nut 106. Further, the full thread nut 112 may be threaded partially into the first cap nut 106 using a tightening tool (not shown). A cross-sectional view of the full thread nut 112 partially threaded into the first cap nut 106 for partially mounting the post 1600 is shown in FIG. 18A, according to an embodiment of the present invention.

In another embodiment of the present invention, the first universal collet 104 may be flipped such that the proximal end 130 of the first universal collet 104 may be inserted into the cavity 122 of the base 110. Further, the second cap nut 108 may be inserted from the distal end 128 of the first universal collet 104. Furthermore, the 2 inches×⅛ inches post may be inserted into the cavity 122 such that the 2 inches×⅛ inches post circumscribes the first universal collet 104, in an embodiment of the present invention. In other embodiments, the post dimensions will be greater than or less than 2 inches×⅛ inches. In an embodiment of the present invention, the full thread nut 112 may be inserted through the opening 124 provided at the distal end 120 of the base 110 and threaded into the second cap nut 108. Further, the full thread nut 112 may be threaded partially into the second cap nut 108 using a tightening tool (not shown), according to an embodiment of the present invention.

Figure 17B:
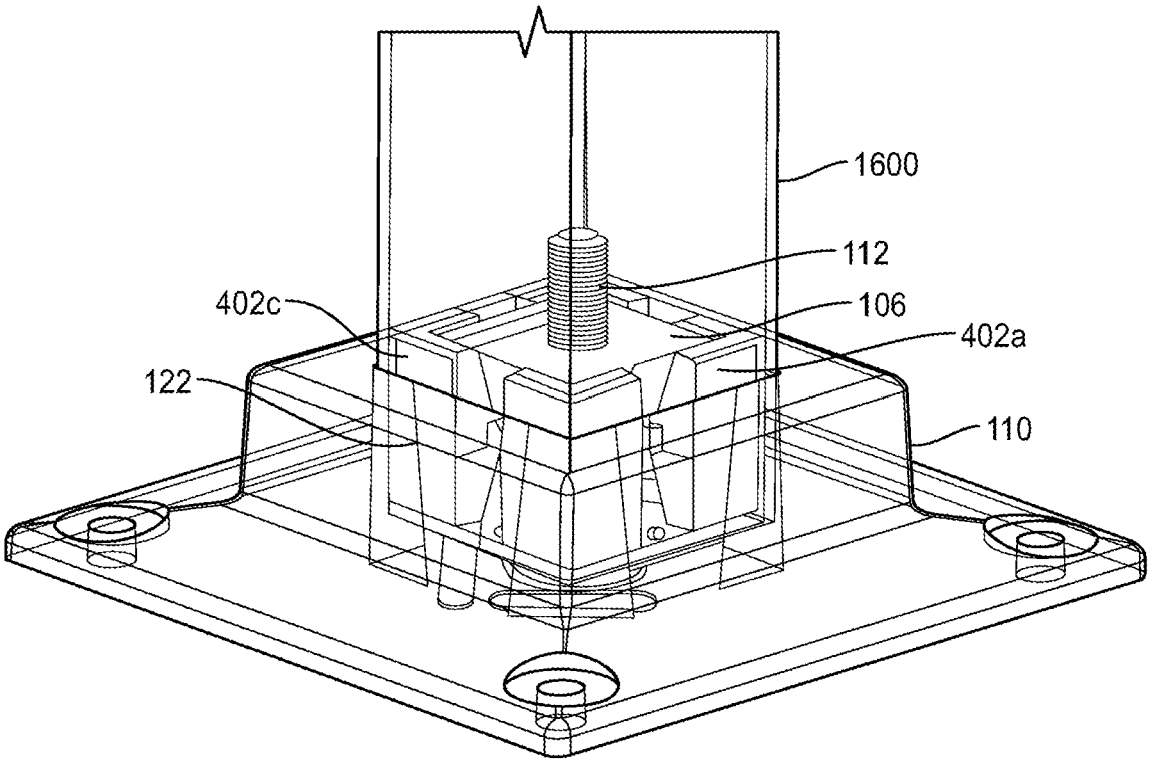
FIG. 17B illustrate an exemplary scenario of completely mounting a post by using the fence post mount device, according to an embodiment of the present invention disclosed herein.

FIG. 17B illustrate an exemplary scenario of completely mounting the post 1600 by using the fence post mount device 100, according to an embodiment of the present invention. According to embodiments of the present invention, the tightening of the full thread nut 112 may force the separation notches 402*a*-402*d* to break such that the collet legs 400*a*-400*d* may be pushed towards an inner wall of the post 1600 (as shown in FIG. 19B). The collet legs 400*a*-400*d* may deform the inner walls of the post 1600 that may enable a tighter fit for the post 1600 inside the cavity 122 of the base 110, according to embodiments of the present invention. According to an embodiment of the present invention, the full thread nut 112 in fully tightened position may extend to a maximum of 2 inches from the first cap nut 106. According to another embodiment of the present invention, the full thread nut 112 in fully tightened position may extend to a maximum of 2 inches from the first cap nut 106. According to an embodiment of the present invention, a cross-sectional view of the full thread nut 112 completely tightened into the first cap nut 106 for completely mounting the post 1600 is shown in FIG. 18B.

Figure 18A:
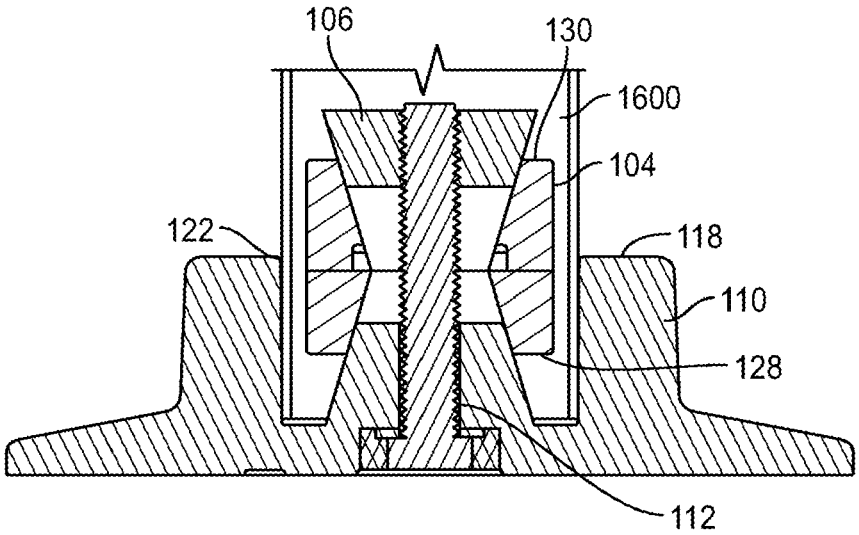
FIG. 18A illustrates a cross sectional view of the exemplary scenario of the FIG. 17A illustrating the post partially mounted using the fence post mount device, according to an embodiment of the present invention disclosed herein.

FIG. 18A illustrates a cross sectional view of the post 1600 partially mounted using the fence post mount device 100, according to an embodiment of the present invention.

Figure 18B:
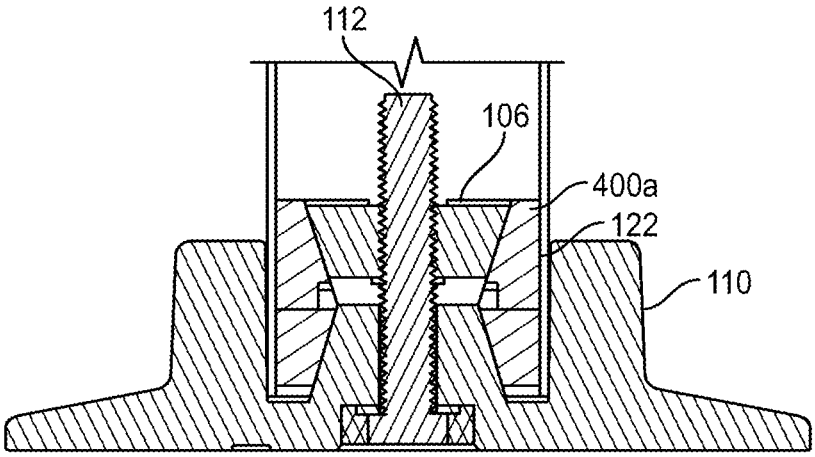
FIG. 18B illustrates a cross sectional view of the exemplary scenario of the FIG. 17A illustrating the post fully mounted using the fence post mount device, according to an embodiment of the present invention disclosed herein.

FIG. 18B illustrates a cross sectional view of the post 1600 fully mounted using the fence post mount device 100, according to an embodiment of the present invention.

Figure 19A:
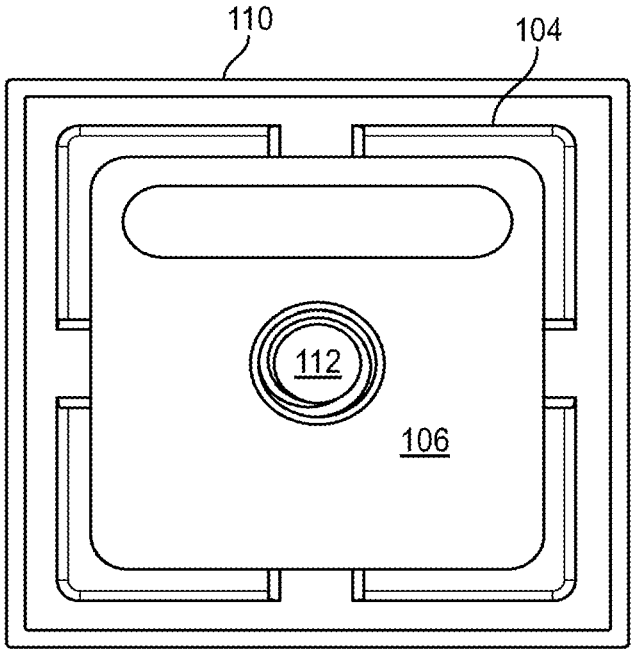
FIG. 19A illustrates a top view of an installation of the first cap nut and the first universal collet into the base with a partially threaded full thread nut, according to an embodiment of the present invention disclosed herein.
Figure 19B:
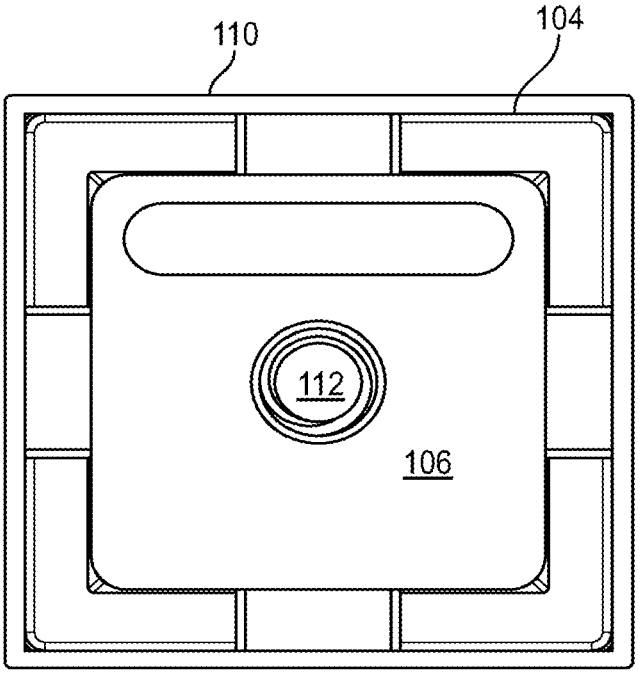
FIG. 19B illustrates a top view of an installation of the first cap nut and the first universal collet into the base with a completely threaded full thread nut, according to an embodiment of the present invention disclosed herein.

FIG. 19A illustrates a top view of an installation of the first cap nut 106 and the first universal collet 104 into the base 110 with a partially threaded full thread nut 112, according to an embodiment of the present invention. FIG. 19B illustrates a top view of an installation of the first cap nut 106 and the first universal collet 104 into the base 110 with the completely threaded full thread nut 112, according to an embodiment of the present invention. According to embodiments of the present invention, the tightening of the full thread nut 112 may force the separation notches 402*a*-402*d* to break such that the collet legs 400*a*-400*d* may be pushed towards an inner wall of the post 1600. The collet legs 400*a*-400*d* may deform the inner walls of the post 1600 that may enable a tighter fit for the post 1600 inside the cavity 122 of the base 110, according to embodiments of the present invention.

The present invention, in various embodiments, configurations, and aspects, includes components, methods, processes, systems and/or apparatus substantially as depicted and described herein, including various embodiments, subcombinations, and subsets thereof. Those of skill in the art will understand how to make and use the present invention after understanding the present disclosure.

The present invention, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

While the foregoing is directed to embodiments of the present disclosure, other and further embodiments of the present disclosure may be devised without departing from the basic scope thereof. It is understood that various embodiments described herein may be utilized in combination with any other embodiment described, without departing from the scope contained herein. Further, the foregoing description is not intended to be exhaustive or to limit the disclosure to the precise form disclosed.

Modifications and variations are possible in light of the above teachings or may be acquired from practice of the disclosure. Certain exemplary embodiments may be identified by use of an open-ended list that includes wording to indicate that the list items are representative of the embodiments and that the list is not intended to represent a closed list exclusive of further embodiments. Such wording may include "e.g.," "etc.," "such as," "for example," "and so forth," "and the like," etc., and other wording as will be apparent from the surrounding context.

What is claimed is:

1. A method comprising:

configuring a cavity with an inner wall extending vertically downward within a base region of a device, wherein the inner wall includes an angled depression;

positioning at least one universal collet to be in contact with the inner wall, wherein the at least one universal collet is configured to deform an inner wall of a post in response to being secured in its positioning;

configuring a thread nut to secure the positioning of the at least one universal collet in position, wherein the thread nut thereby secures the post in position based on securing the positioning of the least one universal collet, wherein the thread nut is secured in a vertical position in an opening parallel to the at least one universal collet in a center region of the cavity; and positioning one or more attachment grooves to secure the thread nut in position.

2. The method of claim 1, wherein the thread nut is configured to tighten the positioning of the at least one universal collet.

3. The method of claim 1, further comprising:

applying a mounting mechanism to secure the post in position around the thread nut and the at least one universal collet.

4. The method of claim 1, further comprising:

attaching the base to one or more surfaces by using at least one of the one or more attachment grooves.

5. The method of claim 1, further comprising:

configuring one or more attachment tools within the one or more attachment grooves to secure at least one of the thread nut or the at least one universal collet.

6. The method of claim 1, further comprising:

configuring the cavity to have an equivalent shape to the post to enable the post to be secured.

7. The method of claim 1, further comprising:

placing the thread nut into a distal end to secure the at least one universal collet in position.

8. A method comprising:

configuring a base at an initial position;

positioning a plurality of attachment grooves on the base to accept one or more attachments;

configuring a universal collet within the base and between the plurality of attachment grooves, wherein the universal collet is configured to be positioned adjacent to a post configured within the base;

positioning a thread nut within at least one of the plurality of attachment grooves to tighten a position of the universal collet, where the thread nut is configured to securely lock the post in position within the base, wherein the thread nut and universal collet are configured within a center region of the base; and configuring a distal end mechanism to secure the thread nut in position.

9. The method of claim 8, wherein the thread nut enables the universal collet to deform an inner wall of the post.

10. The method of claim 8, further comprising:

positioning the thread nut using the distal end mechanism to secure the post within a cavity region of the base.

11. The method of claim 8, further comprising:

positioning and securing the post within a proximal end of the base.

12. The method of claim 8, further comprising:

configuring an opening with a set diameter within the distal end mechanism to secure the thread nut within the base.

13. The method of claim 8, further comprising:

configuring a support nut within a cavity region to secure the post in position within the base.

14. The method of claim 8, further comprising:

configuring an angled depression around a cavity region to be in contact with an external region of the post.

15. A system comprising:

a cavity configured with an inner wall extending vertically downward within a base region of a device, wherein the inner wall includes an angled depression;

a universal collet positioned to be in contact with the inner wall, wherein the at least one universal collet is configured to deform an inner wall of a post in response to being secured in its positioning;

a thread nut configured to secure the positioning of the universal collet in position, wherein the thread nut thereby secures the post in position based on securing the positioning of the least one universal collet, wherein the thread nut is secured in a vertical position in an opening parallel to the universal collet a center region of the cavity; and one or more attachment grooves positioned to secure the thread nut in position.

16. The system of claim 15, wherein the thread nut tightens the position of the universal collet to enable the universal collet to be in contact with a post secured within the cavity.

17. The system of claim 15, wherein the other inner wall is deformed by the universal collet to secure the post in position within the cavity.

18. The system of claim 15, further comprising:

a base cover placed at an initial position to enable the post to be positioned within the cavity.

19. The system of claim 15, further comprising:

a cap nut configured to a set diameter to secure the thread nut in a base region surrounding the post and the cavity.

20. The system of claim 15, further comprising:

a longitudinal groove configured in an adjacent position to the thread nut in a region within the post and the cavity.

* * * * *